US010930448B2

(12) United States Patent
Ito et al.

(10) Patent No.: US 10,930,448 B2
(45) Date of Patent: Feb. 23, 2021

(54) PUSH-BUTTON SWITCH MEMBER

(71) Applicant: SHIN-ETSU POLYMER CO., LTD., Tokyo (JP)

(72) Inventors: Masayuki Ito, Nagano (JP); Toshihiro Motoki, Nagano (JP)

(73) Assignee: SHIN-ETSU POLYMER CO., LTD., Tokyo (JP)

( * ) Notice: Subject to any disclaimer, the term of this patent is extended or adjusted under 35 U.S.C. 154(b) by 0 days.

(21) Appl. No.: 16/471,571

(22) PCT Filed: Nov. 15, 2017

(86) PCT No.: PCT/JP2017/041027
§ 371 (c)(1),
(2) Date: Jun. 20, 2019

(87) PCT Pub. No.: WO2018/116702
PCT Pub. Date: Jun. 28, 2018

(65) Prior Publication Data

US 2020/0006020 A1 Jan. 2, 2020

(30) Foreign Application Priority Data

Dec. 22, 2016 (JP) ..... JP2016-248919

(51) Int. Cl.
*H01H 13/70* (2006.01)
*H01H 13/14* (2006.01)
*H01H 13/79* (2006.01)

(52) U.S. Cl.
CPC ..... *H01H 13/14* (2013.01); *H01H 13/7006* (2013.01); *H01H 13/79* (2013.01);
(Continued)

(58) Field of Classification Search
CPC ..... H01H 13/79; H01H 2203/038; H01H 2215/004; H01H 2215/012;
(Continued)

(56) References Cited

U.S. PATENT DOCUMENTS 3,996,429 A * 12/1976 Chu ..... H01H 13/66 200/5 A
RE29,440 E * 10/1977 Durkee ..... H01H 13/7006 200/5 A
(Continued)

FOREIGN PATENT DOCUMENTS

JP H19-171740 A 6/1997
JP H10-188728 A 7/1998
(Continued)

OTHER PUBLICATIONS

International Search Report in PCT/JP2017/041027, dated Jan. 23, 2018, 4pp.

*Primary Examiner* — Felix O Figueroa
(74) *Attorney, Agent, or Firm* — Hauptman Ham, LLP

(57) ABSTRACT

A push-button switch member includes: a movable contact and an operation key disposed facing the protruding side thereof, and in contact therewith or spaced therefrom. The movable contact includes: an upper contact portion disposed directly under a key body; an outer fixed portion in the upper contact portion or more outward therefrom in the radial direction, and fixed more outward in the radial direction than the key body; and a non-contacting outer portion provided more outward in the radial direction than the upper contact portion, and disposed to face in a non-contacting state another contact so as to be able to contact another contact which is disposed on an outer side in the radial direction and contacted by the upper contact portion when pushed by the key body. The non-contacting outer portion has a bottom
(Continued)

portion for a line contact or a surface contact with another contact.

13 Claims, 19 Drawing Sheets

(52) U.S. Cl.
CPC . *H01H 2205/026* (2013.01); *H01H 2215/012* (2013.01); *H01H 2221/05* (2013.01); *H01H 2231/046* (2013.01)

(58) Field of Classification Search
CPC ..... H01H 2215/014; H01H 2215/018; H01H 2215/022; H01H 2215/026; H01H 2215/0261
See application file for complete search history.

(56) References Cited

U.S. PATENT DOCUMENTS 4,084,071 A * 4/1978 Smith ..... H01H 13/7013 200/1 R
4,289,943 A * 9/1981 Sado ..... H01H 13/702 200/513
4,385,218 A * 5/1983 Nishida ..... H01H 13/12 200/1 B
4,933,522 A * 6/1990 Celander ..... H01H 13/7006 200/513
5,924,555 A 7/1999 Sadamori et al.
6,951,991 B2 * 10/2005 Asada ..... H01H 13/48 200/406
7,199,321 B1 * 4/2007 Huang ..... H01H 13/48 200/406
7,737,373 B2 * 6/2010 In ..... G06F 3/023 200/1 B
2007/0039811 A1 2/2007 Yanai et al.
2014/0090967 A1 4/2014 Inagaki
2014/0110237 A1 * 4/2014 Enomoto ..... H01H 13/85 200/513

FOREIGN PATENT DOCUMENTS

JP H11-111106 A 4/1999
JP 2002-93274 A 3/2002
JP 2005-32705 A 2/2005
JP 2007-52962 A 3/2007
JP 2010-146737 A 7/2010
WO 2012/153587 A1 11/2012

* cited by examiner

Figure 13A
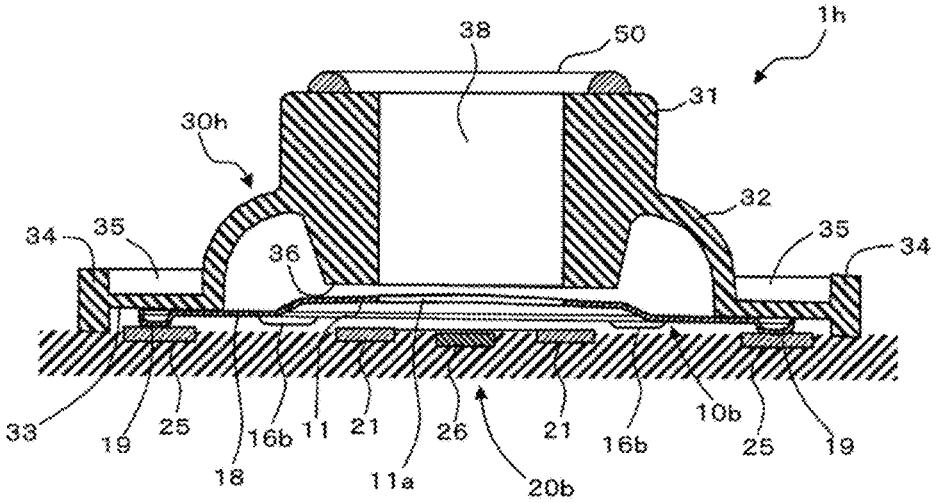
Figure 13B
Figure 13C
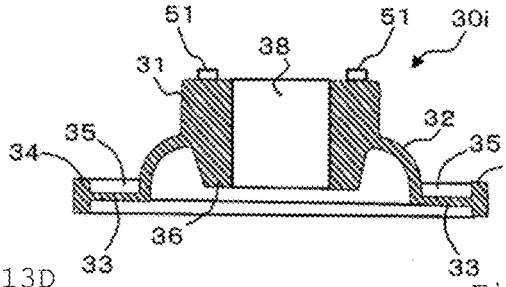
Figure 13D
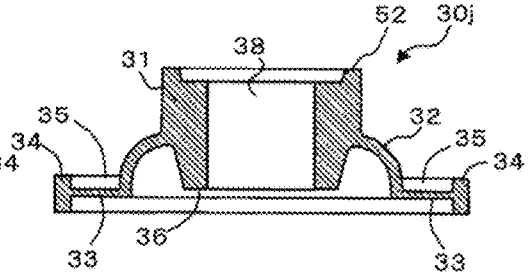
Figure 13E
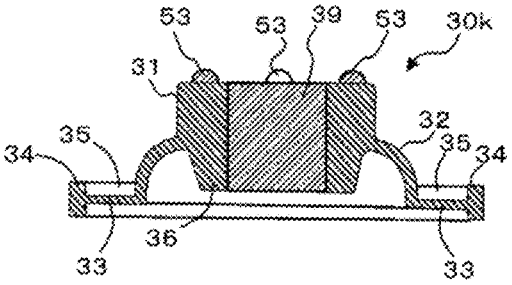
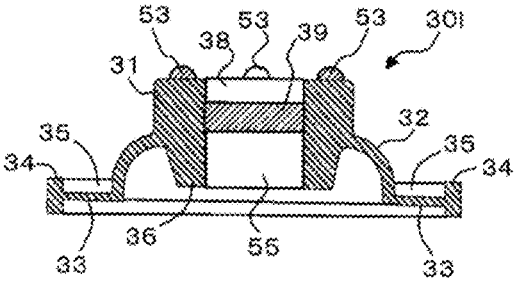

PUSH-BUTTON SWITCH MEMBER

CROSS REFERENCE

This application is a national phase of International Application No. PCT/JP2017/041027 filed Nov. 15, 2017, and claims priority based on Japanese Patent Application No. 2016-248919 filed on Dec. 22, 2016, the contents of which are incorporated herein. The contents described in patents, patent applications, and literatures cited in this application are likewise incorporated herein.

TECHNICAL FIELD

The present invention relates to a push-button switch member.

BACKGROUND ART

Conventionally, a push-button switch member for switching-on by using deformation of a metal dome by pressing its center top portion from outside of the metal dome has been known (see Patent Literature 1, for example). Moreover, with recent progress in size reduction of keys and narrowing of intervals between the keys in line with size reduction of devices incorporating the push-button switch members, demand for highly accurate alignment between each of the keys and the metal dome has increased. If misalignment occurs between a pressing position of the key and the center top portion of the metal dome, a favorable click feeling cannot be obtained. In order to solve such problems, a push-button switch member having the center top portion of the metal dome bonded immediately below the key has been developed (see Patent Literature 2, for example). When the metal dome is connected immediately below the key, positions of the key and the metal dome are fixed, and the center top portion of the metal dome can be pressed at all times. Thus, a merit of the favorable click feeling can be realized.

Particularly, a two-stage switch can be realized (see Patent Literature 3, for example), in which a first fixed contact capable of contact with the center of the metal dome and a second fixed contact capable of contact with an outer periphery of the metal dome are formed on a circuit board side, and when the metal dome is connected to the key in a state of floating from the circuit board, the second fixed contact is brought into contact with the outer periphery of the metal dome by pressing down the metal dome from the key, and the switch is turned on and then, the center part of the metal dome and the first fixed contact are brought into contact, and the switch is turned on.

CITATION LIST

Patent Literature

Patent Literature 1: Japanese Patent Laid-Open No. 10-188728

Patent Literature 2 Japanese Patent Laid-Open No. 2007-52962

Patent Literature 3: International Publication No. WO2012/153587

SUMMARY OF INVENTION

Technical Problem

However, the conventionally well-known push-button switch member described above has the following problems.

The push-button switch member disclosed in Patent Literature 1 has a problem that a high load cannot be handled easily. A thickness, a diameter or curvature of a sheet of the metal dome needs to be increased in order to realize a high-load switch by a metal-dome single body. Thus, durability against repeated deformation is lowered, and a size of the switch is increased. If a rubber switch is disposed above the metal dome in the push-button switch member disclosed in Patent Literature 1, the problem becomes small, but a problem that misalignment can easily occur between a pressor on a lower surface of the rubber switch and the metal dome top portion. The misalignment is not preferable since operation feeling is deteriorated. Moreover, the push-button switch member disclosed in Patent Literature 2 and Patent Literature 3 does not have the problem of misalignment, since the pressor at a position immediately below the rubber switch and the top portion of the metal dome are bonded, but another problem caused by presence of the adhesive occurs. That is, dimensional tolerance in a pressing direction is large due to variation in the thickness of the adhesive, and favorable operation feeling cannot be guaranteed easily. In addition, in a region with an adhesive, the metal dome cannot be deformed easily and thus, a high-click feeling unique to the metal dome cannot be obtained easily.

In order to solve the problems of the conventionally well-known push-button switch member, in a push-button switch member including a dome-shaped movable contact and an operation key, the inventors examined, prior to the present invention, a structure of a movable contact including an upper contact portion disposed immediately below a key body and in contact with a contact by pushing-in of the key body and an outer fixed portion on the upper contact portion or closer to the outer side in a radial direction thereof and fixed closer to the outer side in the radial direction than the key body. With such a structure, it was found that a push-button switch member which can handle a high load with a small size and easily realize a high-click feeling can be obtained.

However, there is a demand for much higher functionality in the push-button switch member with the structure above. That is a demand caused by a shape of the outer contact portion capable of contact with a fixed electrode on the substrate which is a portion formed on the outer side in the radial direction of the upper contact portion having an inverted bowl shape of the movable contact. More specifically, there is a demand for improvement of point-contact between a portion protruding toward a substrate side of the outer contact portion and the fixed electrode on the substrate so that repeated input operations of the switch do not wear out the fixed electrode easily, and an electric resistance value is kept low stably. Moreover, there is also a demand that slight vibration does not occur easily between the outer contact portion of the movable contact and the fixed electrode on the substrate, and reliable on/off is realized at on/off of the switch.

The present invention was made in order to handle the demands and has an object to provide a push-button switch member which can handle a high load with a small size and realize long-term stable switching with a high-click feeling.

Solution to Problem

A push-button switch member of an embodiment for achieving the object is a push-button switch member including a dome-shaped movable contact and an operation key disposed by facing a protruding side of the movable contact in contact with or away from the protruding side of the movable contact and electrically conducting the movable contact with at least two contacts on the substrate by pressing the operation key in a direction of the movable contact, in which the operation key includes a key body, a dome portion connected to an outer periphery of the key body and deformable by pressing on the key body to a substrate side, and a foot portion connected to the outer periphery of the dome portion and fixed onto the substrate, the movable contact includes an upper contact portion disposed immediately below the key body and brought into contact with the contact by pushing-in of the key body, an outer fixed portion on the upper contact portion or closer to an outer side in a radial direction than the upper contact portion and fixed closer to the outer side in the radial direction than the key body of the operation key, and a non-contacting outer contact portion located closer to the outer side in the radial direction of the movable contact than the upper contact portion and disposed by facing in a non-contact state with another contact to be capable of contact with the other contact disposed on the outer side in the radial direction of the contact in contact with the upper contact portion by pushing-in of the key body, and the non-contacting outer contact portion includes a bottom portion capable of linear contact or planar contact with the other contact.

The push-button switch member of another embodiment is a push-button switch member including a dome-shaped movable contact and an operation key disposed by facing a protruding side of the movable contact in contact with or away from the protruding side of the movable contact and electrically conducting the movable contact with at least two contacts on the substrate by pressing the operation key in a direction of the movable contact, in which the operation key includes a key body, a dome portion connected to an outer periphery of the key body and deformable by pressing on the key body to a substrate side, and a foot portion connected to the outer periphery of the dome portion and fixed onto the substrate, and the movable contact includes an upper contact portion disposed immediately below the key body and brought into contact with the contact by pushing-in of the key body, an outer fixed portion on the upper contact portion or closer to the outer side in the radial direction than that and fixed closer to the outer side in the radial direction than the key body of the operation key, and a contacting outer contact portion located closer to the outer side in the radial direction of the movable contact than the upper contact portion and in contact with and disposed on another contact disposed on the outer side in the radial direction of the contact in contact with the upper contact portion.

In the push-button switch member of another embodiment, the movable contact may further include a downward protruding portion located closer to the outer side in the radial direction of the movable contact than the upper contact portion and disposed in a contact or non-contact state with the substrate on the outer side in the radial direction of the contact in contact with the upper contact portion.

In the push-button switch member of another embodiment, moreover, the downward protruding portion may be a non-contacting outer contact portion disposed and facing in the non-contact state with another contact to be capable of contact with the other contact by pushing-in of the key body, and the non-contacting outer contact portion may include a bottom portion capable of linear contact or planar contact with the other contact.

In the push-button switch member of another embodiment, moreover, the operation key may include one or two or more intermediate portions faced with the substrate with a gap between the dome portion and the foot portion, and the movable contact may be disposed by fixing the outer fixed portion to the intermediate portion.

In the push-button switch member of another embodiment, moreover, the movable contact may have a first through hole in a region including a center part on a plan view thereof to be in contact with the key body on a periphery of the first through hole by pushing-in of the operation key.

The push-button switch member of another embodiment, moreover, may be light-transmissive through the first through hole from illuminating means provided on an inner side in the radial direction of the contact in the substrate.

In the push-button switch member of another embodiment, moreover, the operation key may include a recess portion capable of accommodating the illuminating means by downward movement of the key body on a lower part of the key body and may be light-transmissive at least partially.

In the push-button switch member of another embodiment, moreover, the operation key may include a second through hole penetrating the key body from an outer side thereof toward the movable contact.

In the push-button switch member of another embodiment, moreover, the second through hole may have a light-transmissive material embedded over a part or the whole of a length direction thereof.

In the push-button switch member of another embodiment, moreover, the operation key may be made of a light-transmissive material.

The push-button switch member of another embodiment, moreover, may further include a protruding portion provided on a top surface or the outer periphery of the key body and protruding from the top surface of the key body and capable of compression/deformation during an operation of pressing the operation key toward the substrate.

In the push-button switch member of another embodiment, moreover, the protruding portion may be formed having a dot shape, a bar shape, a frame shape or an annular shape on the top surface of the key body.

In the push-button switch member of another embodiment, moreover, the protruding portion may be a columnar portion extending more upward than the top surface of the key body on the outer periphery of the key body.

Advantageous Effects of Invention

The present invention provides a push-button switch member which can handle a high load with a small size and realizes long-term stable switching with a high-click feeling.

BRIEF DESCRIPTION OF DRAWINGS

FIG. 13A illustrates a longitudinal sectional view of a push-button switch member according to a fourth embodiment and FIGS. 13B to 13E illustrate longitudinal sectional views of various variations of the operation key.

DESCRIPTION OF EMBODIMENTS

Next, each embodiment of the present invention will be described by referring to the attached drawings. Each of the embodiments described below is not intended to limit the invention according to the claims, and all the elements described in each embodiment and their combinations are not necessarily indispensable for solution of the present invention.

First Embodiment

Figure 1:
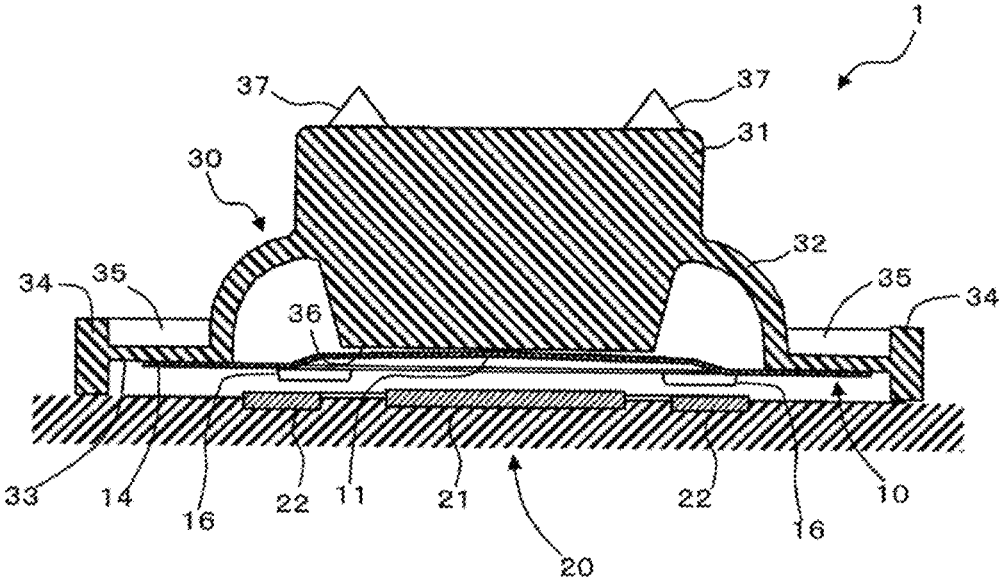
FIG. 1 illustrates a longitudinal sectional view of a push-button switch member according to a first embodiment.
Figure 2:
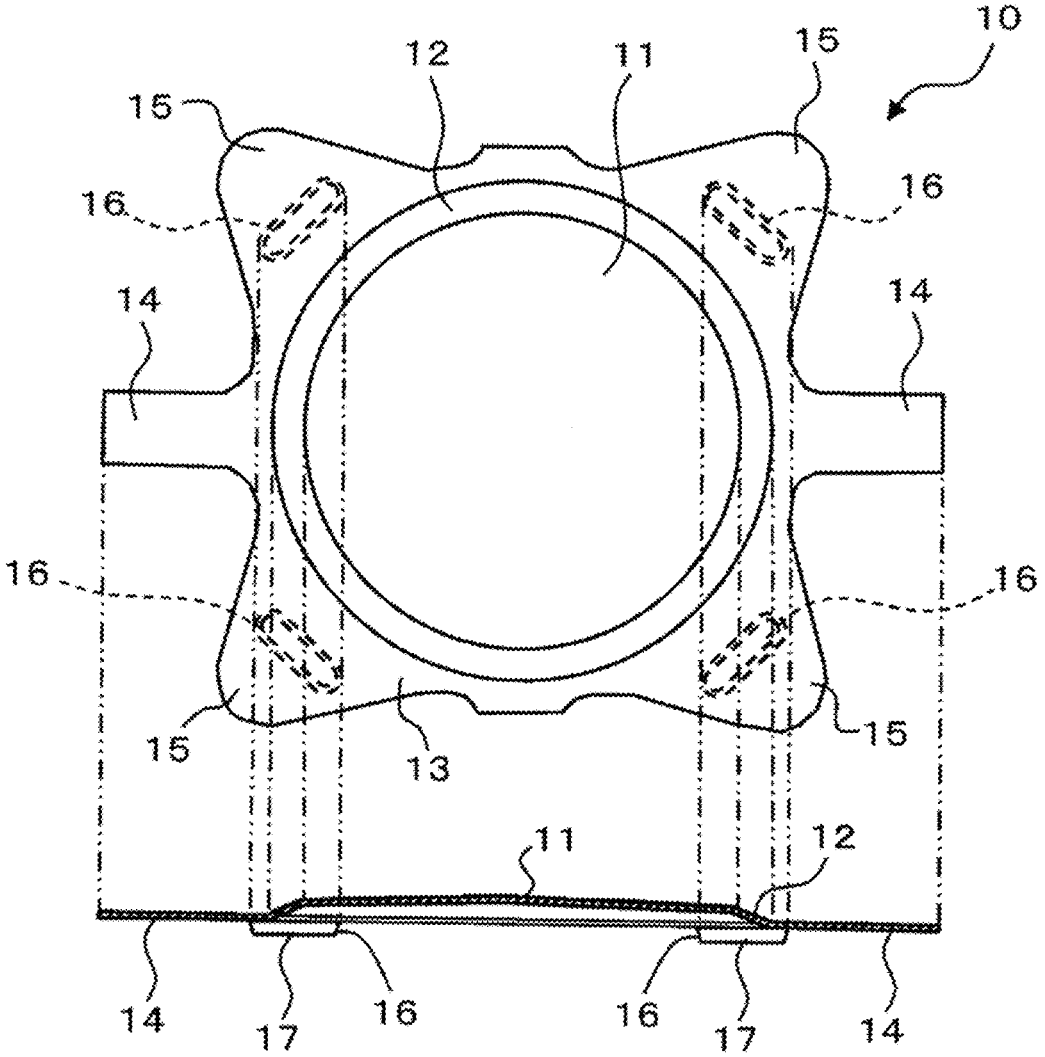
FIG. 2 illustrates a plan view and a longitudinal sectional view of a movable contact in FIG. 1.
Figure 3:
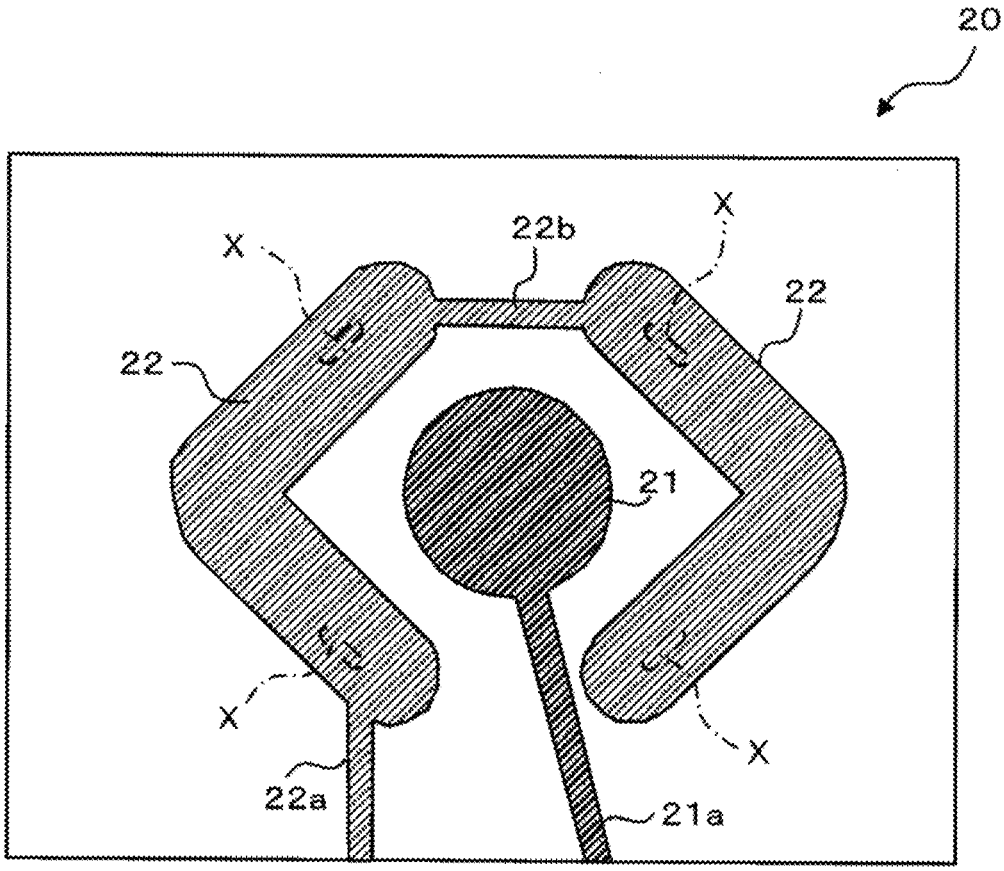
FIG. 3 illustrates a plan view of a substrate in FIG. 1.
Figure 4A:
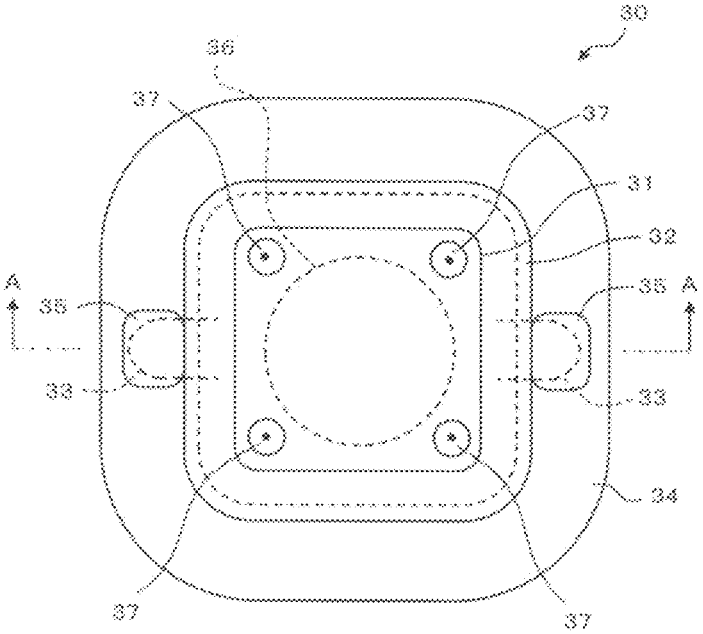
FIG. 4A illustrates a plan view and FIG. 4B illustrates an A-A line sectional view of an operation key in FIG. 1.
Figure 4B:
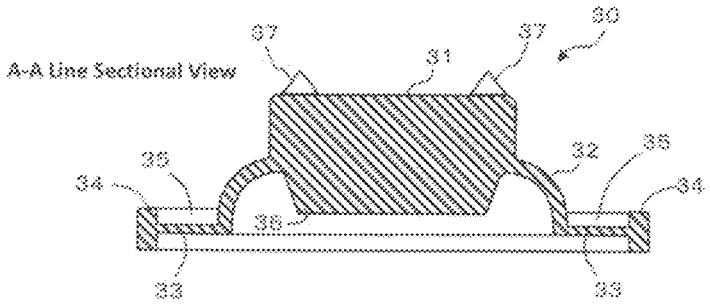

FIG. 1 illustrates a longitudinal sectional view of a push-button switch member according to a first embodiment. FIG. 2 illustrates a plan view and a longitudinal sectional view of a movable contact in FIG. 1. FIG. 3 illustrates a plan view of a substrate in FIG. 1. FIG. 4A illustrates a plan view and FIG. 4B illustrates an A-A line sectional view of an operation key in FIG. 1.

In this application, the term "up", "above" or "upper side" means a direction from a substrate toward the push-button switch member unless particularly defined otherwise. The term "down", "below" or "lower side" means a direction from the push-button switch member toward the substrate. The term "longitudinal" means connection between up and down on the basis of the above definitions. The term "plan view" means a state seen from above. The term "outer side in a radial direction" means a diameter expanding direction of a virtual circle when the virtual circle is drawn from a center of a specific target object on a plan view. The term "inner side in a radial direction" means a diameter reducing direction of the virtual circle.

The push-button switch member 1 according to the first embodiment is a member including a dome-shaped movable contact (hereinafter, referred to simply as a "movable contact") 10 and an operation key 30 disposed on a protruding side of the movable contact 10 in a contact or separated state and electrically conducting the movable contact 10 with at least two contacts 21 and 22 on a substrate (also called a circuit board) 20 by pressing the operation key 30 toward a direction of the movable contact 10. The term "separated" means a non-contact state. Hereinafter, the movable contact 10, the substrate 20, and the operation key 30 will be described in detail on the basis of FIGS. 2, 3, and 4.

(1) Movable Contact

The movable contact 10 includes an upper contact portion 11 disposed immediately below a key body 31 of the operation key 30, which will be described later, and brought into contact with the contact (hereinafter, referred to as a "first contact") 21 on the substrate 20 by pushing-in of the key body 31. The upper contact portion 11 is a member having a dome shape protruding upward and a substantially circular shape on a plan view in this embodiment, but may have the other shapes on the plan view such as a polygon. The movable contact 10 includes the upper contact portion 11, a stepped portion 12 formed on an outer periphery of the upper contact portion 11 and having an annular shape on the plan view and bent downward and a baseboard portion 13 consecutively connected to the outer side in the radial direction of the stepped portion 12. The stepped portion 12 is a member having a substantially annular shape on the plan view and a diameter expanded downward from an inner side in the radial direction toward the outside in this embodiment. However, the shape on the plan view of the stepped portion 12 may be other shapes such as a polygon.

The movable contact 10 includes a band portion 14 which is an example of an outer fixed portion on the upper contact portion 11 or closer to the outer side in the radial direction than that and fixed closer to the outer side in the radial direction than the key body 31 of the operation key 30. The band portion 14 is a portion having a substantially rectangular shape on the plan view and extending elongatedly to the outer side in the radial direction from facing two sides of the movable contact 10 on the plan view. The movable contact 10 is disposed by fixing the band portion 14 to the operation key 30. The baseboard portion 13 has a shape with portions 15, 15, 15, and 15 corresponding to four corners of a substantial rectangle protruding on diagonal lines on the plan view. The band portion 14 is an outer fixed portion extending toward the outer side in the radial direction from the baseboard portion 13 and located closer to the outer side in the radial direction than the upper contact portion 11 and fixed closer to the outer side in the radial direction than the key body 31. In this embodiment, the portion of the movable contact 10 fixed to the operation key 30 is only the band portion 14.

Before pushing the operation key 30 into the substrate 20 side, an upper surface of the upper contact portion 11 and a lower surface of a pressor 36 are in contact in a non-fixed state without an adhesive layer (a layer of an adhesive or a double-sided tape, for example) or separated from each other with a gap between them. The same applies to a relationship between the pressor 36 and the movable contacts 10, 10*a*, 10*b*, 10*c*, 10*d*, 10*e*, 10*f*, 10*g*, and 10*n* in each of the subsequent embodiments. The movable contact 10 includes an outer contact portion (called a "non-contacting outer contact portion" in this embodiment) 16 disposed by facing in a non-contact state with a contact (hereinafter, called a "second contact") 22 to become capable of contact with the second contact 22 located closer to the outer side in the radial direction of the movable contact 10 than the upper contact portion 11 and disposed on the outer side in the radial direction of another contact (hereinafter, called a "first contact") 21 in contact with the upper contact portion 11 by pushing-in of the key body 31. The non-contacting outer contact portion 16 is a region of a portion 15 of the baseboard portion 13 and is formed on the lower surface of the baseboard portion 13 to face the substrate 20. A gap between the non-contacting outer contact portion 16 and the second contact 22 is not particularly restricted as long as the both 16 and 22 can be brought into contact when the operation key 30 is pushed into the direction of a substrate 40. The gap between the non-contacting outer contact portion 16 and the second contact 22 is set within a range from 0.03 to 0.1 mm in this embodiment.

When the operation key 30 is pushed into the substrate 20 side, the pressor 36 located below the key body 31 can push down the upper contact portion 11 of the movable contact 10 to the direction of the substrate 40. As a result of this pushing-down, first, the movable contact 10 is generally lowered, and the non-contacting outer contact portion 16 is brought into contact with the second contact 22. Then, in the movable contact 10 having received pressing from the pressor 36, the stepped portion 12 is inverted, and the upper contact portion 11 is brought into contact with the first contact 21. The stepped portion 12 can be a fulcrum of deflection deformation of the upper contact portion 11.

The non-contacting outer contact portion 16 is provided one each on the portions 15, 15, 15, and 15 at the four corners of the baseboard portion 13. Thus, when the key body 31 is to be pushed in, the movable contact 10 can be brought into contact with the second contact 22 at four spots. However, the number of the non-contacting outer contact portions 16 is not particularly limited as long as it is one or more. In order that the movable contact 10 is not tilted when the movable contact 10 is brought into contact with the second contact 22, one or two sets or more of two units of the non-contacting outer contact portions 16 are preferably provided at positions faced with the center of the movable contact 10 between them.

The non-contacting outer contact portion 16 includes a bottom portion 17 capable of planar contact with the second contact 22 in contact with that. In this embodiment, the bottom portion 17 is a surface substantially in parallel with the upper surface of the second contact 22. However, as will be described in the subsequent embodiments, the bottom portion 17 may be a portion capable of linear contact with the second contact 22. That is, the bottom portion 17 may be a portion in linear contact or planar contact as long as it is a portion not in point contact with the second contact 22. Here, in order to provide the bottom portion 17 not in point contact, a length of a portion where the non-contacting outer contact portion 16 is in contact with the second contact 22 is preferably 0.2 mm or more or more preferably 0.5 mm or more when the movable contact 10 receives pressing from the key body 31. As described above, when the non-contacting outer contact portion 16 is in linear contact or planar contact with the second contact 22, wearing of the second contact 22 can be suppressed, a rise of electric resistance of the second contact 22 can be suppressed, and alternate repetition of a state where the non-contacting outer contact portion 16 and the second contact 22 are electrically connected and a state not connected during on/off of the switch can be suppressed even if the push-button switch member 1 is used for a long time.

As a constituting material of the movable contact 10, a conductive metal material can be used. Examples of the metal material include stainless steel, aluminum, aluminum alloy, carbon steel, copper, copper alloy (bronze, phosphor bronze, brass, nickel, nickel silver and the like), silver or an alloy of two or more selected from the aforementioned metals. Particularly preferable metal material is SUS301, but austenitic stainless steel other than SUS301, martensitic stainless steel, ferrite-based stainless steel or austenitic-ferrite double-phase stainless steel or the like may be used. The movable contact 10 may be constituted by a resin-based material. The movable contact 10 can be manufactured by forming a film of carbon, gold, silver or copper on one surface of a transparent resin such as polypropylene, poly methyl methacrylate, polystyrene, polyamide 6, polyamide 66, polyamide 610, polyethyleneterephthalate, polyethylene naphthalate, polycarbonate or the like and by applying molding into an inverted bowl shape. Even if the movable contact 10 is constituted by metal or a resin, surface treatment such as plating or deposition is preferably applied in a single layer or plural layers to the surface in contact at least with the contacts 21 and 22 of the movable contact 10 for corrosion resistance, dust resistance or stable conductivity. As the surface treatment, application of gold-plating (thickness: approximately 0.05 μm) and sealing at the same time is particularly preferable. The thickness of the gold-plating is preferably as large as possible theoretically from a viewpoint of corrosion resistance. However, it is restricted from a viewpoint of costs in actuality to 0.01 μm or more and 1.00 μm or less, preferably 0.03 μm or more and 0.50 μm or less, or more preferably 0.05 μm or more and 0.30 μm or less. Examples of the surface treatment other than the above include gold-plating, nickel-plating and gold-plating and sealing, nickel-plating and gold-plating, nickel-plating, silver-plating, nickel-plating and silver-plating, silver-plating and sealing (sulfurization preventing treatment (=coloration preventing treatment)), nickel-plating and silver-plating and sealing (sulfurization preventing treatment (=coloration preventing treatment)), and application of carbon-based conductive ink or carbon-based conductive paint. A gold alloy, a silver alloy, palladium, a palladium alloy, tungsten or a tungsten alloy may be used for the surface treatment.

(2) Substrate

As illustrated in FIG. 3, the substrate 20 preferably includes the first contact 21 at a position immediately below the upper contact portion 11 of the movable contact 10. In this embodiment, a shape of the first contact 21 on the plan view is substantially circular, but the shape is not restricted and may be other shapes such as a polygon. The first contact 21 is electrically connected from a part thereof to another spot through a line 21*a*. However, description of the other spot will be omitted. The substrate 20 includes the second contact 22 not electrically connected to the first contact 21 on the outer side in the radial direction of the first contact 21. In this embodiment, the shape of the second contact 22 is a substantial V-shape on the plan view, but the shape is not restricted and may be other shapes. Two pieces of the substantially V-shaped second contacts 22 are provided on the substrate 20. The two second contacts 22 and 22 are connected by a line 22*b*. Thus, the two substantially V-shaped second contacts 22 and 22 connected by the line 22*b* may be called one second contact 22. Hereinafter, they will be described as the one second contact 22. The second contact 22 is electrically connected from a part thereof to another spot through the line 22*a* similarly to the first contact 21. However, description of the other spot will be omitted. The second contact 22 is provided at a position capable of contact with the four non-contacting outer contact portions 16, 16, 16, and 16 of the movable contact 10 on the substrate 20. Four contact traces X, X, X, and X in FIG. 3 are traces of contact between bottom portions 17, 17, 17, and 17 of the non-contacting outer contact portions 16, 16, 16, and 16 with the second contact 22. Such traces are not necessarily left on the surface of the second contact 22 in actuality but they are illustrated in FIG. 3 so that the planar contact between the bottom portion 17 and the second contact 22 can be understood easily.

The substrate 20 is formed by a material with excellent insulating properties, and the materials can include a paper-phenol substrate in which a paper base material is solidified by a phenol resin, a paper-epoxy substrate in which the paper base material is solidified by an epoxy resin, a glass epoxy substrate in which a cloth woven by glass fibers is solidified by an epoxy resin, and a glass composite substrate in which paper and a glass base material are mixed and solidified. In addition, a ceramics substrate formed of ceramics with high insulating properties such as alumina and a resin substrate formed of a resin with high insulating properties such as polytetrafluoroethylene, polyimide, and the like can be cited as suitable examples. The first contact 21 and the second contact 22 are suitably constituted by a material with relatively high conductivity in metal such as gold, silver, copper, aluminum bronze, aluminum alloy or an alloy of two or more of them. Plating may be applied in a single layer or plural layers to the surfaces of the first contact 21 and the second contact 22 for corrosion resistance or stable conductivity. The plating can include plating of gold, silver, nickel and the like or alloy plating having one or more of them as a main component, for example.

(3) Operation Key

The operation key 30 includes the key body 31, a dome portion 32 connected to an outer periphery of the key body 31 and constituted deformable by pressing on the key body 31 to the substrate 20 side, a foot portion 34 connected to the outer periphery of the dome portion 32 and fixed onto the substrate 20, and a protruding portion 37 provided on a top surface of the key body 31, protruding from the top surface of the key body 31, and capable of compression/deformation during a pressing operation on the operation key 30 toward the substrate 20. The operation key 30 preferably includes two intermediate portions 33 faced with the substrate 20 with a gap between the dome portion 32 and the foot portion 34 as illustrated in FIG. 4A and FIG. 4B. The two intermediate portions 33 are formed at positions faced with each other with a center part between them on the plan view of the operation key 30 and correspond to a fixed portion with the movable contact 10. The operation key 30 includes a recess portion 35 dented downward above the intermediate portion 33. Thus, the intermediate portion 33 is formed thinner than a length (thickness) of the foot portion 34 in a vertical direction. When the operation key 30 is pressed/operated, the dome portion 32 is gradually deformed, and with that, a downward deforming force and a force to the outer side in the XY direction acting on and deforming the foot portion 34 work. By making the intermediate portion 33 thin so that it can be stretched and deformed easily with a small force, a stress on the fixed portion with the movable contact 10 can be reduced. As a result, the downward stress on the movable contact 10 and the force to the direction pulled to the outside can be made to escape. In this embodiment, the intermediate portion 33 is made thin by providing the recess portion 35, and a clearance is also provided between the band portion 14 of the movable contact 10 and the foot portion 34. However, the recess portion 35 is not an indispensable constitution and in an application of switching with a load larger than that for pressing/deforming the movable contact 10, means such as a change in the thickness of the dome portion 32 and formation of the recess portion 35, deformation of the thickness of the dome portion 32 and non-formation of the recess portion 35 or non-change of the thickness of the dome portion 32 and non-formation of the recess portion 35 can be used in order to fabricate the push-button switch member 1 according to the application by employing other means such as change of the thickness of the dome portion 32.

The key body 31 has a substantially cuboid shape and is supported by the dome portion 32 in a state floating from the substrate 20. The key body 31 includes the pressor 36 protruding having a substantially columnar shape toward the substrate 20 on a lower side at a substantial center on the plan view. The pressor 36 is a portion pressing the upper contact portion 11 of the movable contact 10 downward. The dome portion 32 is a member having a square cylindrical shape on the plan view and enlarging the diameter from the key body 31 side toward the substrate 20 side. The dome portion 32 is a thin elastic member designed such that it is deformed in the middle of pressing-down on the key body 31 to the direction of the substrate 20 and then, is returned to the original shape, when the pressing-down is cancelled. In this embodiment, the entire operation key 30 including the dome portion 32 is constituted by an elastic material, but only the dome portion 32 may be constituted by the elastic material. The foot portion 34 is a thin plate having a rectangular shape (including a regular square) on the plan view and has a shape of causing a portion other than the intermediate portion 33 to contact the substrate 20.

The protruding portion 37 is a constituting portion having a substantially conical shape (or "substantially cone-shaped") provided on the top surface of the key body 31. In this embodiment, one each at four corners of the key body 31 on the plan view, that is, four pieces in total of them are provided. The protruding portion 37 is provided at a position capable of compression/deformation when a finger or other members touch the top surface of the key body 31. In a method of pushing-in the key body 31 with the finger, for example, the protruding portions 37 only need to be disposed so that a region surrounded by the four protruding portions 37 is narrower than a contact region of the finger on the top surface of the key body 31. The protruding portion 37 is constituted by a relatively soft material to be capable of compression/deformation from when pressing from above the operation key 30 is started until the movable contact 10 is deformed and brought into contact with the second contact 22, and the switch is turned on.

As a constituting material for the operation key 30, thermosetting elastomers such as silicone rubber, urethane rubber, isoprene rubber, ethylene-propylene rubber, natural rubber, ethylene-propylene-diene rubber or styrene-butadiene rubber; thermoplastic elastomers such as urethane-based, ester-based, styrene-based, olefin-based, butadiene-based or fluorine-based, or composites of them or the like are preferably used. As the constituting material of the operation key 30 other than the above, styrene-butadiene rubber (SBR) or nitrile rubber (NBR) may be also used. Alternatively, a filler represented by titanium oxide and carbon black may be mixed with the above constituting materials. When illuminating means (an LED as an example) is provided on the substrate 20 and light emitted from the LED is transmitted through a part of the operation key 30 in design, at least a part (a portion through which the light from the LED passes) or the whole of the operation key 30 is preferably light transmissive. By constituting the entire operation key 30 by a light-transmissive material such as silicone rubber, light can be emitted from the LED through an arbitrary spot of the operation key 30.

The protruding portion 37 disposed on the top surface of the key body 31 may be formed by either one of the same as the above materials of the operation key 30 or a different material but is preferably capable of compression/deformation until the lower surface of the pressor 36 deforms the movable contact 10. The entire operation key 30 including the protruding portion 37 may be constituted by the same material (silicone rubber, for example). In order to make the compression/deformation of the protruding portion 37 more marked, the constituting material of the protruding portion 37 can be made a softer material than the key body 31, and a bottom area of the protruding portion 37 can be made smaller or a height of the protruding portion 37 can be made larger.

Second Embodiment

Next, a push-button switch member according to a second embodiment will be described. In the second embodiment, portions in common with the first embodiment are given the same reference numerals, the description in the first embodiment for the constitution or operation thereof is used in place, and duplicated description will be omitted.

Figure 5:
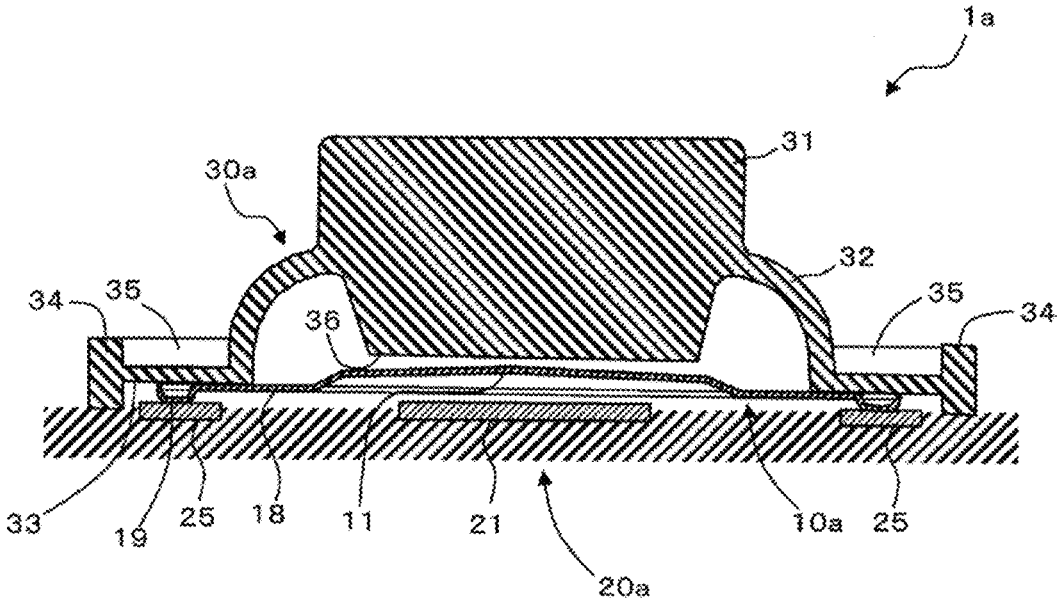
FIG. 5 illustrates a longitudinal sectional view of a push-button switch member according to a second embodiment.
Figure 6:
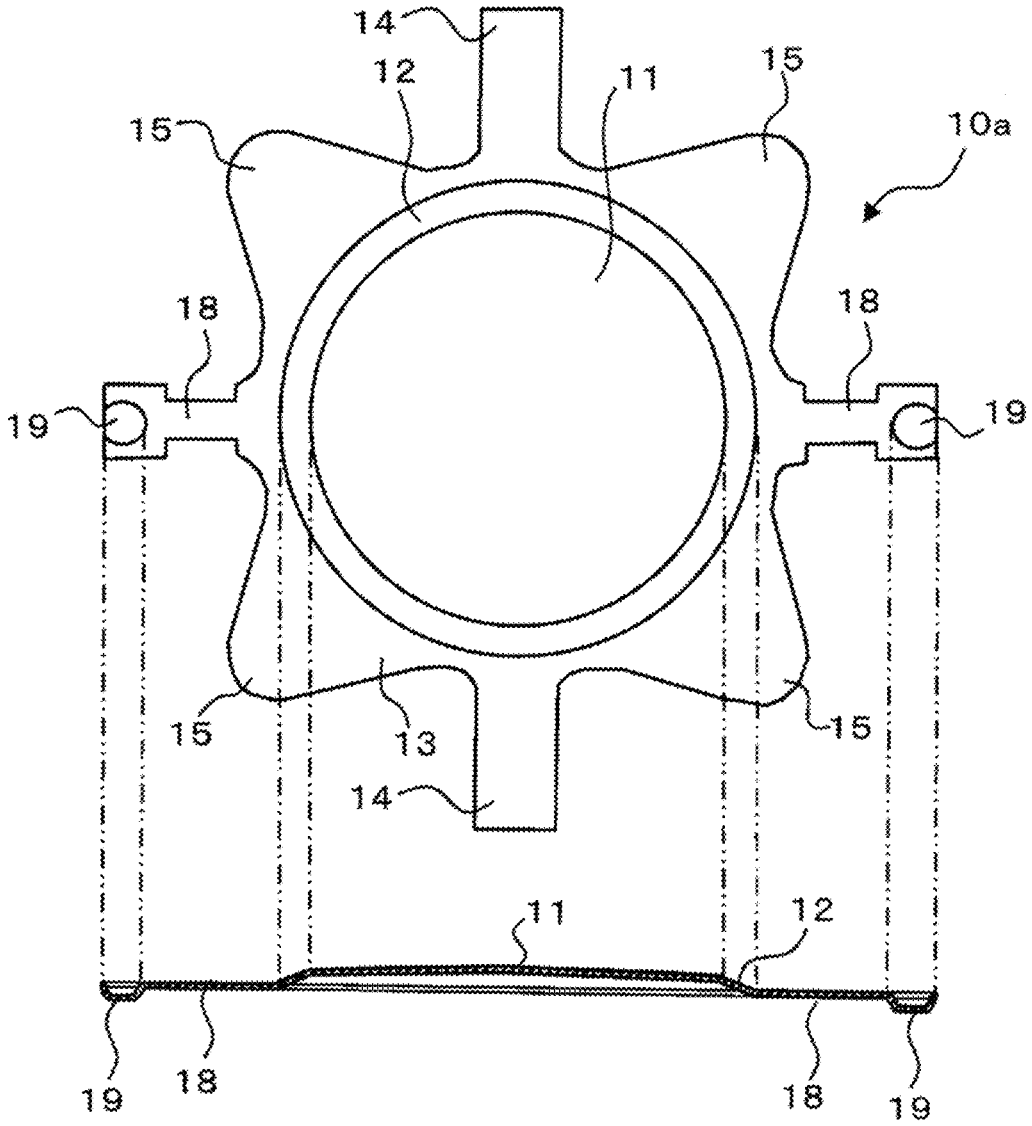
FIG. 6 illustrates a plan view and a longitudinal sectional view of a movable contact in FIG. 5.
Figure 7:
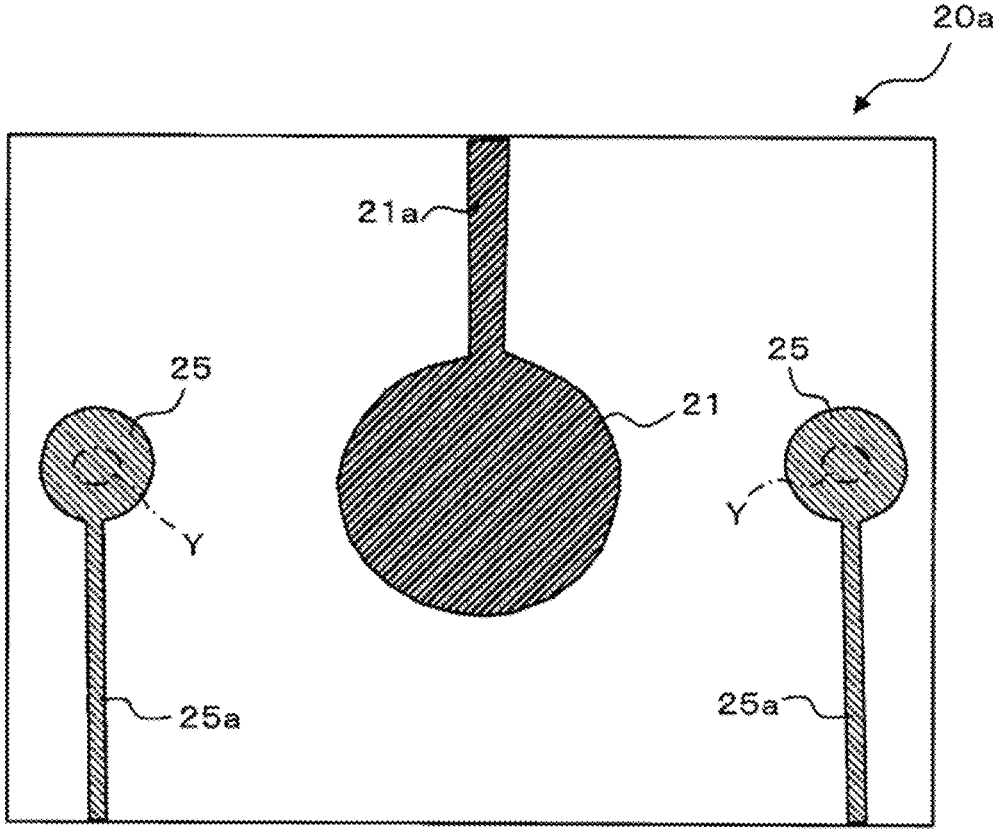
FIG. 7 illustrates a plan view of a substrate in FIG. 5.

FIG. 5 illustrates a longitudinal sectional view of the push-button switch member according to the second embodiment. FIG. 6 illustrates a plan view and a longitudinal sectional view of the movable contact in FIG. 5. FIG. 7 illustrates a plan view of the substrate in FIG. 5.

When a push-button switch member 1*a* according to the second embodiment is compared with the push-button switch member 1 according to the first embodiment described above, a shape of the movable contact and a shape of each contact on the substrate are different. A situation of the top surface of the operation key is also different. These different points will be mainly described below.

(1) Movable Contact

In this embodiment, a movable contact 10*a* does not include the non-contacting outer contact portion 16 on the lower surface of the baseboard portion 13 but includes a contacting outer contact portion 18 extending to the outer side in the radial direction from two sides faced with each other on the plan view of the baseboard portion 13, respectively, as illustrated in FIG. 6. The push-button switch member 1*a* according to this embodiment includes two band portions 14 similarly to the push-button switch member 1 according to the first embodiment. The baseboard portion 13 includes two contacting outer contact portions 18 on another pair of facing two-sides not including the band portions 14. The contacting outer contact portion 18 is located closer to the outer side in the radial direction of the movable contact 10*a* than the upper contact portion 11 and disposed in contact with the second contact 25 disposed on the outer side in the radial direction of the first contact 21 in a state not pressed by the operation key 30*a*. The contacting outer contact portion 18 includes a portion 19 protruding downward and in contact with the second contact 25 in the vicinity of a distal end on the outer side in the radial direction of the movable contact 10*a*. The portion 19 is in contact with the second contact 25 at all times. Moreover, since a portion of the contacting outer contact portion 18 has a spring function, it is deformed upon receipt of a pressure, and the force applied on the portion 19 is relaxed. As a result, wearing of the second contact 25 caused by repetition of an input operation hardly occurs.

(2) Substrate

In this embodiment, a substrate 20*a* includes contacts 21 and 25 having shapes different from the substrate 20 in the first embodiment. The second contacts 25 and 25 each having a substantially circular shape are disposed on both sides in the radial direction of the first contact 21 in contact with the upper contact portion 11 when the operation key 30*a* is pressed. The second contacts 25 and 25 can have any size or shape as long as they are located at positions in contact with the portions 19 and 19 of the movable contact 10*a*. The second contacts 25 and 25 are electrically connected from parts thereof to other spots through lines 25*a* and 25*a*. However, description of the other spots will be omitted.

Before the key body 31 is pressed, the two second contacts 25 and 25 are in an electrically connected state by the movable contact 10*a*. Thus, an electric current flows between the second contacts 25 and 25. When the key body 31 is pressed in this state, the upper contact portion 11 is brought into contact with the first contact 21. As a result, the electric current flows also between the second contact 25 and the first contact 21. As another form, a method in which the electric current flows as below can be also employed. Before the key body 31 is pressed, the two second contacts 25 and 25 are in the state connected by the movable contact 10*a*, but the electric current does not flow. When the key body 31 is pressed in this state, the upper contact portion 11 is brought into contact with the first contact 21. The electric current flowing to the first contact 21 through the line 21*a* also flows to the two second contacts 25 and 25 through the movable contact 10*a*.

FIG. 7 illustrates contact portions Y and Y between the second contacts 25 and 25 and the portions 19 and 19 of the contacting outer contact portion 18. The contact portions Y and Y are portions where the portions 19 and 19 are in contact with the second contacts 25 and 25 at all times. The portions 19 and 19 do not necessarily have to be portions in linear contact or planar contact with the second contacts 25 and 25. However, the portions 19 and 19 are more preferably portions in linear contact or planar contact with the second contacts 25 and 25.

(3) Operation Key

The operation key 30*a* in this embodiment includes a form similar to the operation key 30 in the first embodiment but does not include the protruding portion 37 on the top surface of the key body 31. On the other hand, when the key body 31 is not pressed, the pressor 36 is not in contact with the upper contact portion 11 of the movable contact 10*a*. As described above, instead of providing the protruding portion 37, the upper contact portion 11 and the pressor 36 are separated from each other so that a high-stroke switch operation feeling is not lost. However, the protruding portion 37 may be provided on the top surface of the key body 31, and the stroke of the operation key 30*a* may be made longer. Moreover, if a demand for a high stroke is low, the upper contact portion 11 and the pressor 36 may be kept in contact at all times, and the protruding portion 37 does not have to be provided on the top surface of the key body 31. The operation key 30*a* includes the intermediate portions 33 in four directions forming a substantial cross-shape on the plan view. The facing two intermediate portions 33 are for fixing the band portion 14. The other facing two intermediate portions 33 are only for pressing (or for fixing) the contacting outer contact portion 18 from above. The recess portion 35 is provided immediately above the intermediate portion 33 in this embodiment, but the recess portion 35 is not necessarily required. Particularly, the recess portion 35 does not have to be provided immediately above the intermediate portion 33 for holding or fixing the contacting outer contact portion 18. The same applies to the following embodiments.

As described above, the push-button switch member 1*a* according to the second embodiment as a push-button switch member includes the dome-shaped movable contact 10*a* and the operation key 30*a* disposed by facing the protruding side of the movable contact 10*a* in contact with or away from that and electrically conducts the movable contact 10*a* with at least the two contacts 21 and 25 on the substrate 20*a* by pressing the operation key 30*a* in the direction of the movable contact 10*a*. The operation key 30*a* includes the key body 31, the dome portion 32 connected to the outer periphery of the key body 31 and deformable by pressing on the key body 31 to the substrate 20*a* side, and the foot portion 34 connected to the outer periphery of the dome portion 32 and fixed onto the substrate 20*a*. The movable contact 10*a* includes the upper contact portion 11 disposed immediately below the key body 31 and brought into contact with the first contact 21 by pushing-in of the key body 31, the band portion 14 as the outer fixed portion on the upper contact portion 11 or closer to the outer side in the radial direction than that and fixed closer to the outer side in the radial direction than the key body 31 of the operation key 30*a*, and the contacting outer contact portions 18 and 18 in contact with and disposed on the second contacts 25 and 25 closer to the outer side in the radial direction of the movable contact 10*a* than the upper contact portion 11 and disposed on the outer side in the radial direction of the first contact 21.

Third Embodiment

Next, a push-button switch member according to a third embodiment will be described. In the third embodiment, portions in common with each of the embodiments described above are given the same reference numerals, the description in each of the aforementioned embodiments for the constitution or operation thereof is used in place, and duplicated description will be omitted.

Figure 8:
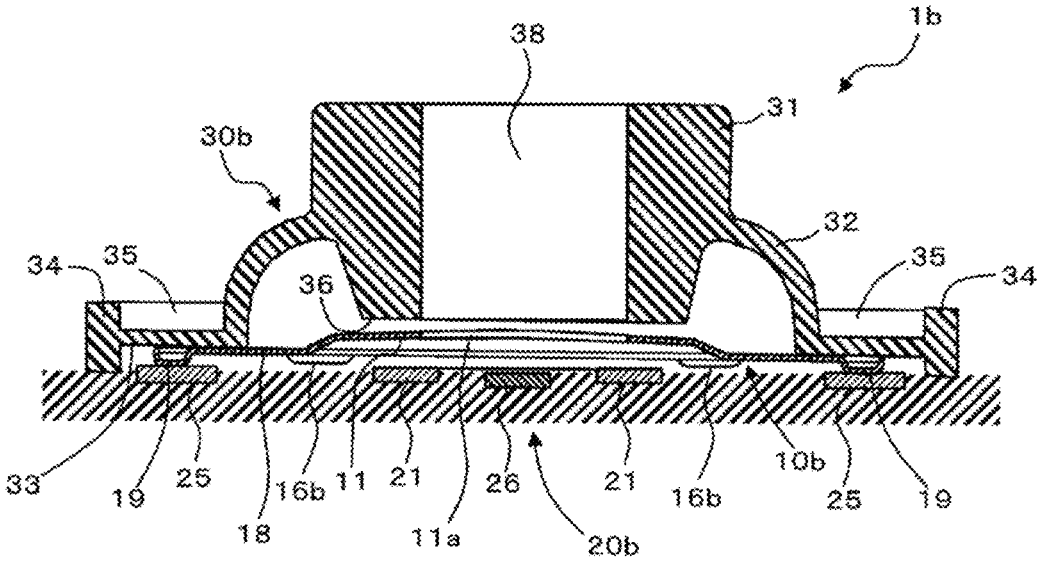
FIG. 8 illustrates a longitudinal sectional view of a push-button switch member according to a third embodiment.
Figure 9:
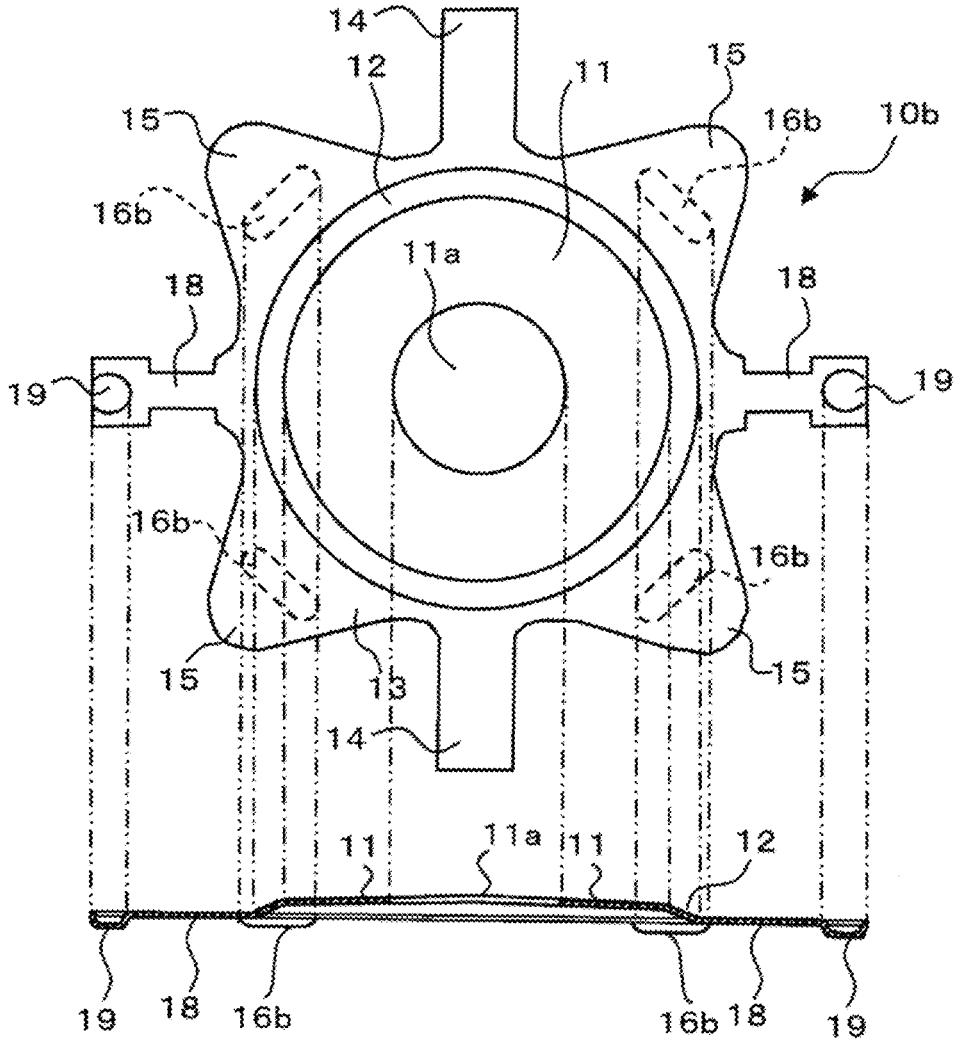
FIG. 9 illustrates a plan view and a longitudinal sectional view of a movable contact in FIG. 8.
Figure 10:
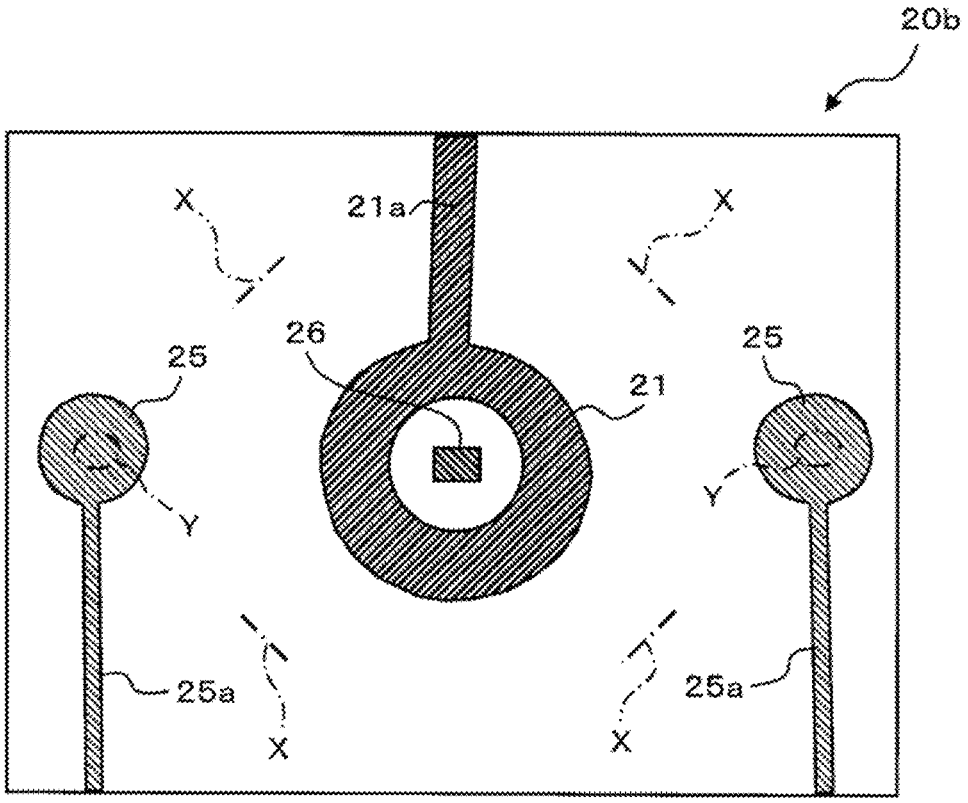
FIG. 10 illustrates a plan view of a substrate in FIG. 8.

FIG. 8 illustrates a longitudinal sectional view of a push-button switch member according to the third embodiment. FIG. 9 illustrates a plan view and a longitudinal sectional view of a movable contact in FIG. 8. FIG. 10 illustrates a plan view of a substrate in FIG. 8.

When a push-button switch member 1*b* according to the third embodiment is compared with the push-button switch member 1*a* according to the second embodiment described above, a shape of the movable contact, a form on the substrate, and a form of the operation key are different. These different points will be mainly described below.

(1) Movable Contact

In this embodiment, a movable contact 10*b* includes the contacting outer contact portions 18 and 18 extending toward the outer side in the radial direction from the baseboard portion 13 and the band portions 14 and 14 similarly to the second embodiment as illustrated in FIG. 9. The movable contact 10*b* includes, unlike the second embodiment, downward protruding portions 16*b*, 16*b*, 16*b*, and 16*b* on the lower surface of the baseboard portion 13, each having a form similar to the non-contacting outer contact portion 16 in the first embodiment.

The contacting outer contact portion 18 is located closer to the outer side in the radial direction of the movable contact 10*b* than the upper contact portion 11 and in contact with and disposed on the second contact 25 disposed on the outer side in the radial direction of the first contact 21 while not pressed from an operation key 30*b*. On the other hand, the downward protruding portions 16*b*, 16*b*, 16*b*, and 16*b* are not in contact on the substrate 20*b* while not pressed from the operation key 30*b*. In each of the downward protruding portions 16*b*, a shape of a bottom portion is an elongated arc shape. When the operation key 30*b* is pressed toward the substrate 20*b*, the downward protruding portions 16*b*, 16*b*, 16*b*, and 16*b* of the movable contact 10*b* are not brought into contact with either one of the first contact 21 or the second contact 25 on the substrate 20*b*. The downward protruding portions 16*b*, 16*b*, 16*b*, and 16*b* have a function of distributing a pressure so that an excessive force is not applied to the second contacts 25 and 25 from the contacting outer contact portions 18 and 18 during an input operation of the switch. Since the portion of the contacting outer contact portion 18 has a spring function, it is deformed when a pressure is applied, and a force applied to the portion 19 is relaxed. The downward protruding portions 16*b*, 16*b*, 16*b*, and 16*b* may be in contact on the substrate 20*b* even without pressing from the operation key 30*b*.

The movable contact 10*b* includes a first through hole 11*a* penetrating a region including a substantial center part of the upper contact portion 11 in the vertical direction on the plan view. The movable contact 10*b* is brought into contact with the pressor 36 of the key body 31 on the periphery of the first through hole 11*a* by pushing-in of the operation key 30*b*. As will be described later, the substrate 20*b* includes an LED 26 which is an example of the illuminating means on the inner side in the radial direction of the first contact 21. In this embodiment, the first through hole 11*a* is located in a direction immediately above the LED 26. Thus, light from the LED 26 can be transmitted through the first through hole 11*a*.

(2) Substrate

In this embodiment, the substrate 20*b* includes the ring-shaped first contact 21, unlike the substrate 20*a* in the second embodiment. The substrate 20*b* includes the LED 26 in the ring of the first contact 21. However, instead of the LED 26, other illuminating means such as an organic EL, an inorganic EL, a filament heat-generating bulb and the like may be used. The second contacts 25 and 25 and the lines 25*a* and 25*a* are in common with the second embodiment. As illustrated in FIG. 10, four lines X illustrated in a region not including the contacts 21 and 25 of the substrate 20*b* are contact traces with which the arc-shaped portions of the downward protruding portions 16*b*, 16*b*, 16*b*, and 16*b* of the movable contact 10*b* are in contact. Contact portions Y and Y on the second contacts 25 and 25 are portions where the portions 19 and 19 are in contact with the second contacts 25 and 25 at all times. At the switch input, the movable contact 10*b* is brought into contact with the substrate 20*b* through the portions 19 and 19 and the downward protruding portions 16*b*, 16*b*, 16*b*, and 16*b*. As a result, a load on the second contacts 25 and 25 can be reduced, and damage (including wear) on the second contacts 25 and 25 can be prevented. The downward protruding portions 16*b*, 16*b*, 16*b*, and 16*b* may be in planar contact on the substrate 20*b* instead of the linear contact. In that case, the downward protruding portion 16*b* preferably includes the bottom portion 17 as a surface substantially in parallel with the substrate 20*b* as the non-contacting outer contact portion 16 in the first embodiment. In this embodiment, the downward protruding portion 16*b* is in contact with the region where the contacts 21 and 25 are not present on the substrate 20*b*. Thus, the downward protruding portion 16*b* is not limited to a portion of the linear contact or planar contact as above but may be a portion of a point contact.

(3) Operation Key

The operation key 30*b* in this embodiment is different from the operation keys 30 and 30*a* according to each of the aforementioned embodiments in a point that the key body 31 includes a second through hole 38 penetrating it from a top surface thereof toward the movable contact 10*b*. The second through hole 38 is located immediately above the first through hole 11*a* of the movable contact 10*b* and can be formed having a diameter larger than, smaller than or the same as that of the first through hole 11*a*. However, the diameter of the second through hole 38 is preferably made the same as or larger than the diameter of the first through hole 11*a* to lead the light transmitted through the first through hole 11*a* from the LED 26 to the top surface of the key body 31 without any leak. On the other hand, in order to have the entire surface of the second through hole 38 on the plan view to illuminate more uniformly, the diameter of the second through hole 38 is preferably made the same as or smaller than the diameter of the first through hole 11*a*. The operation key 30*b* does not necessarily have to be constituted by a light-transmissive material but may be constituted by a light-transmissive material.

As describe above, in the push-button switch member 1*b* according to the third embodiment, the movable contact 10*b* is located closer to the outer side in the radial direction of the movable contact 10*b* than the upper contact portion 11 and includes the downward protruding portions 16*b*, 16*b*, 16*b*, and 16*b* disposed in the non-contact state on the substrate 20*b* on the outer side in the radial direction of the first contact 21 with which the upper contact portion 11 is in contact. Thus, the load from the movable contact 10*b* on the second contacts 25 and 25 can be reduced, and damage on the second contacts 25 and 25 can be prevented.

(4) Deformation of the Third Embodiment

In the third embodiment, the downward protruding portion 16*b* is not in contact with the contacts 21 and 25. However, similarly to the non-contacting outer contact portion 16 in the first embodiment, the downward protruding portion 16*b* may be capable of contact with the second contact 22 on the substrate 20. In that case, the portion 19 of the contacting outer contact portion 18 and the downward protruding portion 16*b* may be brought into contact with the second contact 22 by using the substrate 20 in the first embodiment. By means of such constitution, only the portion 19 of the contacting outer contact portion 18 is in contact on the second contact 22 before pressing on the key body 31, and the downward protruding portion 16*b* is also brought into contact with the second contact 22 after the pressing. That is, the downward protruding portion 16*b* is the non-contacting outer contact portion 16 facing and disposed in the non-contact state with the second contact 22 at non-pressing to become capable of contact with the second contact 22 by pushing-in of the key body 31. In such a case, the downward protruding portion 16*b* preferably includes the bottom portion 17 in linear contact or planar contact with the second contact 22 not to damage the second contact 22 as much as possible.

(Variation of Movable Contact)

Figure 11A:
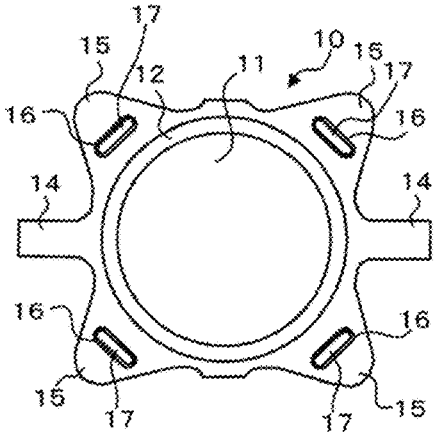
FIGS. 11A to 11E illustrate rear views of various variations of the movable contact in FIG. 2.

FIG. 11A illustrates rear views of a movable contact in FIG. 2 and FIGS. 11B to 11E illustrate various variations thereof.

Figure 11B:
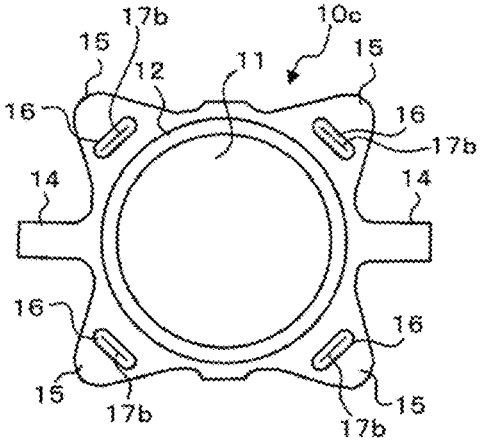
Figure 11C:
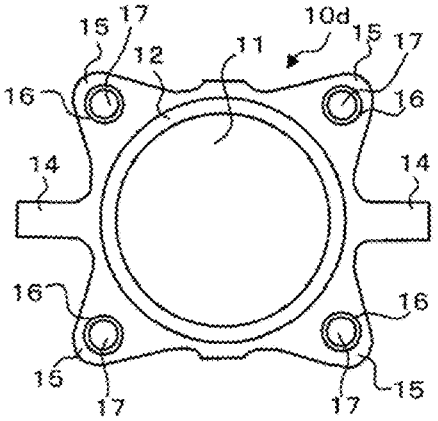
Figure 11D:
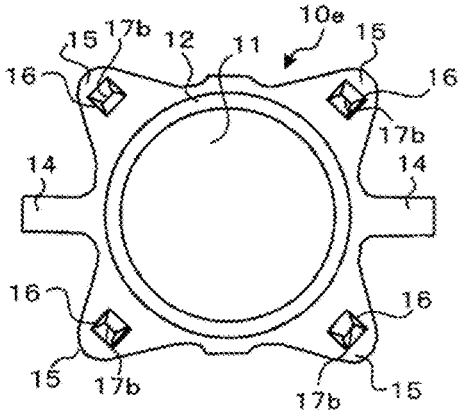
Figure 11E:
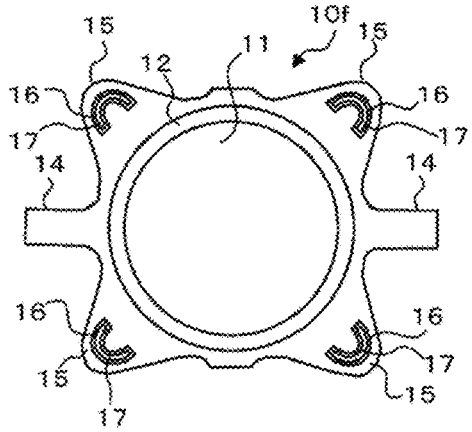

The movable contact 10*c* in FIG. 11B includes a variation of the non-contacting outer contact portion 16 of the movable contact 10 in FIG. 11*a*. The non-contacting outer contact portion 16 of the movable contact 10*c* includes a bottom portion 17*b* having a thin edge shape below. The bottom portion 17*b* is a portion capable of linear contact with the second contact 22. The movable contact 10*d* in FIG. 11C includes a variation into a substantially circular shape of the non-contacting outer contact portion 16 of the movable contact 10 on a rear view. The non-contacting outer contact portion 16 of the movable contact 10*b* includes the bottom portion 17 having a substantially circular plane below. The bottom portion 17 is a portion capable of planar contact with the second contact 22. The movable contact 10*e* in FIG. 11D includes a variation of the non-contacting outer contact portion 16 of the movable contact 10. The non-contacting outer contact portion 16 of the movable contact 10*e* includes a bottom portion 17*b* having a substantially rectangular shape on the rear view and a thin edge shape below. The bottom portion 17*b* is a portion capable of linear contact with the second contact 22. The movable contact 10*f* in FIG. 11E includes a variation into a horse-shoe shape on the rear view of the non-contacting outer contact portion 16 of the movable contact 10. The non-contacting outer contact portion 16 of the movable contact 10*f* includes the bottom portion 17 having a substantially horse-shoe shaped plane below. The bottom portion 17 is a portion capable of planar contact with the second contact 22. The aforementioned various non-contacting outer contact portions 16 can be also applied to the downward protruding portion 16*b* of the movable contact 10*b* in the third embodiment.

(Variation of Fixing Method of Operation Key and Movable Contact)

Figure 12:
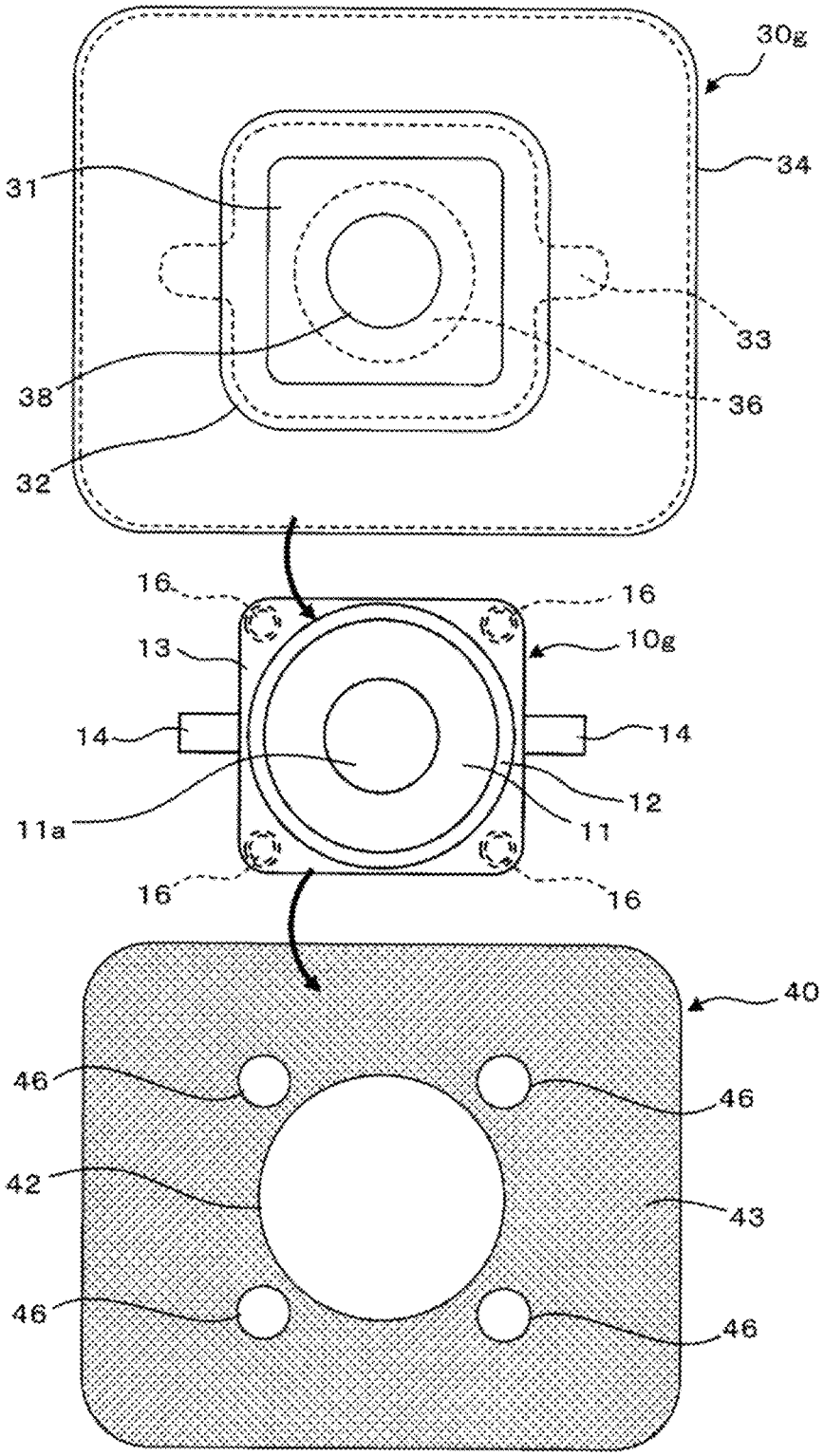
FIG. 12 illustrates a view for explaining a variation of a method for fixing the movable contact to a lower surface of the operation key.

FIG. 12 illustrates a view for explaining a variation of a method of fixing the movable contact to the lower surface of the operation key.

An operation key 30*g* illustrated in FIG. 12 includes the second through hole 38. The band portion 14 of the movable contact 10*g* is fixed to the intermediate portion 33 of the operation key 30*g*. There is no adhesive layer between the band portion 14 and the intermediate portion 33. By disposing the movable contact 10*g* on the rear side of the operation key 30*g*, and by bonding a fixing sheet 40 from its rear side, the movable contact 10*g* can be fixed to the operation key 30*g*. The fixing sheet 40 includes a hole 42 larger than the first through hole 11*a* so that inversion of the upper contact portion 11 is not prevented, and the light from the LED 26 is not prevented, either. Moreover, the fixing sheet 40 includes holes 46 so that the four non-contacting outer contact portions 16 can be protruded to the substrate 20 side, respectively.

The fixing sheet 40 has an insulating base material and an adhesive layer 43 provided on one of surfaces of the insulating base material. The fixing sheet 40 includes the adhesive layer 43 having a size within a range capable of being bonded to a region including at least peripheries of the band portion 14 and the intermediate portion 33 of the operation key 30*g*. In FIG. 12, the region of the adhesive layer 43 is a region on the outer side in the radial direction of the upper contact portion 11 of the movable contact 10*g* and excluding the non-contacting outer contact portion 16. When the movable contact 10*g* and the operation key 30*g* are fixed by using such fixing sheet 40, such a situation that the band portion 14 is removed from the intermediate portion 33 and is moved to the substrate 20 side by repetition of pressing on the operation key 30*g* can be effectively prevented. It is preferable that the adhesive layer 43 does not partially protrude to the substrate 20 side but becomes substantially flat. Thus, the thickness of the band portion 14 is preferably made substantially the same as a depth of the intermediate portion 33. When the fixing sheet 40 is bonded to the intermediate portion 33, by fixing the band portion 14 and the intermediate portion 33 in a substantially flat state without a step, air is not allowed to enter the periphery of the band portion 14, and the adhesive layer 43 of the fixing sheet 40 and the band portion 14 can be brought into close contact. Moreover, such a state that the substrate 20 is contaminated by the adhesive, which damages the conductivity or that the stroke becomes longer than setting, which deteriorates switch feeling or durability can be also avoided.

The insulating base material constituting the fixing sheet 40 is suitably constituted by various resins such as polyolefin, polyamide, polyimide, polyester, polycarbonate, fluorine resins, polyphenylene sulfide, acrylic resins and the like. The adhesive layer 43 may be not only a layer including the adhesive but also a layer including a tackifier. The thickness of the fixing sheet 40 is not particularly restricted and it is preferably 15 to 500 μm, more preferably 20 to 300 μm, or further more preferably 30 to 200 μm. The fixing sheet 40 may be manufactured by combining a desired insulating base material and the adhesive layer 43, or a commercial film with tackifier or a commercial film with adhesive may be also used. When a PET film with silicone-based tackifier (or adhesive), a polyphenylene sulfide film with silicone-based tackifier (or adhesive), a polyimide film with silicone-based tackifier (or adhesive), a fluorine resin film with silicone-based tackifier (or adhesive), a polyester film with an acrylic tackifier (or adhesive) or the like are available on the market. When heat resistance or chemical resistance is required, those using polyphenylene sulfide, polyimide or fluorine resin for the insulating base material are preferable. When the fixing sheet 40 having the adhesive layer 43 constituted by a tackifier (or adhesive) other than silicone is used, urethane coating treatment, surface reforming treatment (ultraviolet irradiation treatment, corona treatment, plasma irradiation treatment, frame treatment or Itro treatment) is preferably applied at least to an adhesive surface with the fixing sheet 40 on the foot portion 34 to improve fixation to the operation key 30*g*.

Fourth Embodiment

Next, a push-button switch member according to a fourth embodiment will be described. In the fourth embodiment, portions in common with each of the embodiments described above are given the same reference numerals, the description in each of the aforementioned embodiments for the constitution or operation thereof is used in place, and duplicated description will be omitted.

FIG. 13A illustrates a longitudinal sectional view of a push-button switch member according to a fourth embodiment and FIGS. 13B to 13E illustrate longitudinal sectional views of various variations of the operation key.

A push-button switch member 1*h* according to the fourth embodiment has a form similar to the push-button switch member 1*b* according to the third embodiment but is different from the push-button switch member 1*b* in a point that an annular protruding portion 50 having a semi-circular longitudinal section on the plan view is provided on the top surface of the key body 31. A high-stroke switch operation is also made possible even if the protruding portion 37 in the first embodiment is changed to the protruding portion 50. However, a circular region on the inner side in the radial direction of the protruding portion 50 is preferably larger than the second through hole 38 not to prevent a light path from the LED 26.

The protruding portion 50 may be changed to a protruding portion 51 formed having an island shape on the four corners on the top surface of an operation key 30*i* in FIG. 13B. Moreover, the protruding portion 50 may be changed to a protruding portion 52 formed having a square ring shape on a peripheral edge portion of the top surface of an operation key 30*j* in FIG. 13C.

Furthermore, the protruding portion 50 may be changed to a protruding portion 53 having a semi-circular longitudinal section scattered on the top surface of an operation key 30*k* in FIG. 13D. With regard to an operation key 30*k*, the entirety thereof is not formed by a light-transmissive material, but a filling member 39 made of the light-transmissive material is formed in the second through hole 38. The entirety of the operation key 30*k* may be formed by a mixed material in which a colored or light-shielding material such as a carbon-based filler or the like is distributed in the light-transmissive material, and the filling member 39 made of the light-transmissive material may be formed in the second through hole 38. As another variation, the operation key 30*k* may be constituted by the light-transmissive material, and a light-shielding layer may be formed on the surface other than the region corresponding to the filling member 39. An operation key 30*l* in FIG. 13E includes the filling member 39 having a thickness smaller than the vertical direction of the key body 31 in the second through hole 38 of the operation key 30*k*. As described above, the filling member 39 does not have to fill the whole space of the second through hole 38. In this case, the operation key 30*l* includes a recess portion 55 capable of accommodating the LED 26 by downward movement of the key body 31 on a lower part of the key body 31.

Fifth Embodiment

Next, a push-button switch member according to a fifth embodiment will be described. In the fifth embodiment, portions in common with each of the embodiments described above are given the same reference numerals, the description in each of the aforementioned embodiments for the constitution or operation thereof is used in place, and duplicated description will be omitted.

Figure 14:
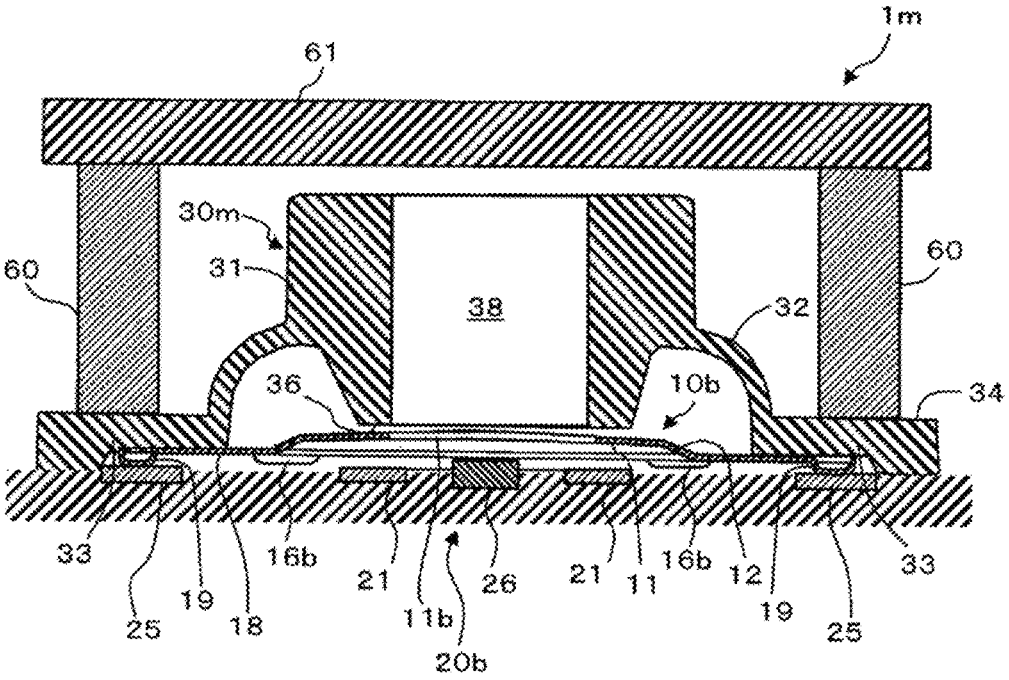
FIG. 14 illustrates a longitudinal sectional view of a push-button switch member according to a fifth embodiment.

FIG. 14 illustrates a longitudinal sectional view of the push-button switch member according to the fifth embodiment.

A push-button switch member 1*m* according to the fifth embodiment includes the movable contact 10*b* of the push-button switch member 1*b* according to the third embodiment and the substrate 20*b* but includes an operation key 30*m* having a form different from the operation key 30*b* of the push-button switch member 1*b* and the other structural members.

The operation key 30*m* holds the contacting outer contact portion 18 of the movable contact 10*b* in the facing two intermediate portions 33. The recess portion 35 is not provided above the intermediate portion 33. The protruding portion is not provided on the top surface of the key body 31. The push-button switch member 1*m* is provided on the outer periphery of the key body 31, protrudes more upward than the top surface of the key body 31, and includes a protruding portion 60 capable of compression/deformation during the operation of pressing the operation key 30*m* toward the substrate 20*b* and a plate-shaped operation plate 61 fixed to an upper part of the protruding portion 60 to have a gap from the top surface of the key body 31. The protruding portion 60 is a columnar portion located on the outer periphery of the key body 31 and extending more upward than the top surface of the key body 31. The protruding portion 60 and the operation plate 61 are members used instead of the protruding portion 37 or the like and contributes to higher stroke during the pressing operation. Moreover, the operation key 30*m* includes no recess portion 35 formed in the operation key 30*a* in the above embodiment. That is because the foot portion 34 has to have a shape not deformed easily due to a need to receive pressing from the protruding portion 60 by the foot portion 34 during the pressing operation. In this embodiment, the protruding portion 60 is a wall surrounding the key body 31 but may be four columns disposed in the periphery of the key body 31 at substantially equal center angles (approximately 90 degrees) on the plan view. Whether the protruding portion 60 is formed by a light-transmissive material or not does not matter, but the operation plate 61 is preferably formed by the light-transmissive material to transmit the light from the LED 26 to the outside. The protruding portion 60 is constituted by a relatively soft material to be capable of compression/deformation from when pressing from above the operation key 30 is started until the movable contact 10*b* is deformed and is brought into contact with the first contact 21, and the switch is turned on for the reason similar to the protruding portion 37 in the first embodiment. On the other hand, the operation plate 61 preferably includes rigidity higher than that of the protruding portion 60 so that the protruding portion 60 can be compressed/deformed with priority when the operation plate 61 is pressed from above. When the protruding portion 60 is constituted by silicone rubber, for example, the operation plate 61 can be constituted by a polycarbonate resin. The protruding portion 60 may be formed by the same material as the key body 31 and integrally with the key body 31.

(Use Example of Push-Button Switch Member)

Figure 15A:
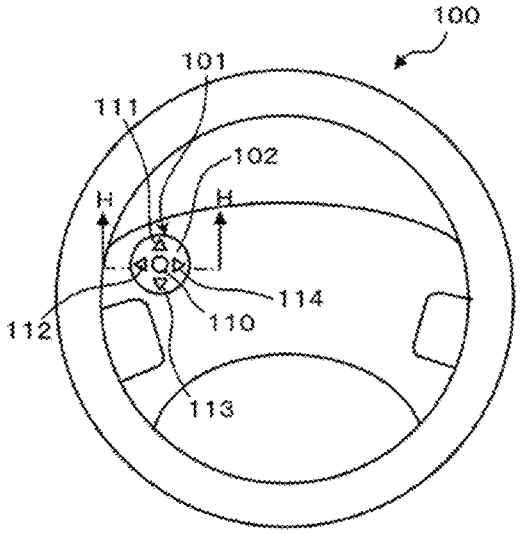
FIG. 15A illustrates views for explaining application examples of the push-button switch member to which a plurality of operation keys are attached and illustrates a front view of a state where a multi-key including the push-button switch member is incorporated in a steering wheel of an automobile.
Figure 15B:
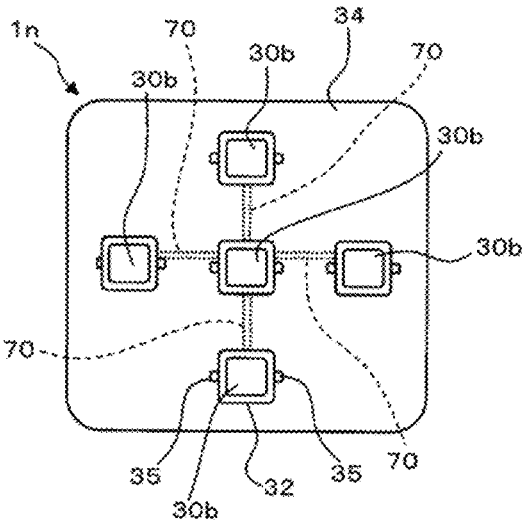
FIG. 15B illustrates a front view of a state where a front cover above the multi-key is removed, and FIG. 15C illustrate an H-H line sectional view in FIG. 15A of the multi-key.
Figure 15C:
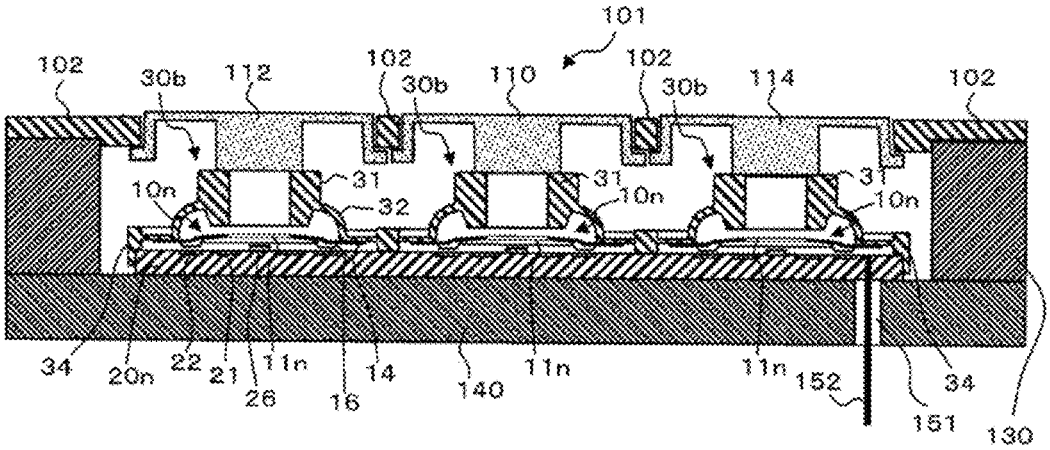

FIGS. 15A to 15C illustrate views for explaining application examples of the push-button switch member to which a plurality of operation keys are attached and FIG. 15A illustrates a front view of a state where a multi-key including the push-button switch member is incorporated in a steering wheel of an automobile, FIG. 15B illustrates a front view of a state where a front cover above the multi-key is removed, and FIG. 15C illustrates an H-H line sectional view in FIG. 15A of the multi-key.

As illustrated in FIGS. 15A and 15B, a multi-key 101 including a push-button switch member 1*n* to which a plurality of (here, five) operation keys 30*b* is attached is incorporated in a steering wheel 100 of an automobile. The multi-key 101 includes outer-peripheral keys 111, 112, 113, and 114 at substantially equal angles in peripheral four directions of a center key 110. When a front cover 102 is removed from the multi-key 101, as illustrated in FIG. 15B, the push-button switch member 1*n* is provided. The push-button switch member 1*n* includes operation keys 30*b*, each corresponding to the keys 110, 111, 112, 113, and 114, respectively. The foot portion 34 of the operation key 30*b* is a foot portion in common with each of the keys 110, 111, 112, 113, and 114. The operation key 30*b* has an air channel 70. Thus, air resistance during the operation can be reduced.

Each of the operation keys 30*b* is constituted capable of vertical movement independently of each other. The key body 31 has a square form on the plan view. The keys 110, 111, 112, 113, and 114 (called as the "key 110 and the like" as appropriate) include an operation key 30*b* immediately below them. The key 110 and the like are constituted by a material with high light transmissivity so that the light transmitted through the operation key 30*n* from the LED 26 on the substrate 20*b* can be transmitted to an outer direction easily. The operation key 30*b* is disposed with the immediately lower part of the key body 31 in contact with the vicinity of a top part of the movable contact 10*n*. A collection of the operation keys 30*b* is surrounded by a housing 130 on the outer periphery thereof. A substrate 20*n* is fixed onto a back plate 140 and has an upper part of its outer side portion covered by the foot portion 34 of the key body 31. The back plate 140 includes a through hole 151 reaching the substrate 20*n*. Each of the contacts (first contact 21 and second contact 22) on the substrate 20*n* and the LED 26 are connected to a plurality of electric wiring 152 electrically connected to them though the through hole 151. The movable contact 10*n* includes the non-contacting outer contact portion 16 and is constituted capable of bringing the non-contacting outer contact portion 16 into contact with the second contact 22 upon receipt of pressing from the key body 31. The movable contact 10*n* includes a first through hole 11*n* at a center part on the top surface. A peripheral edge part of the first through hole 11*n* is brought into contact with the first contact 21 disposed annularly on the plan view on the outer side in the radial direction of the LED 26 upon receipt of pressing from the key body 31.

As described above, the push-button switch member 1*n* is capable of realizing various operations not preventing driving of an automobile by being incorporated in a steering wheel 100 of an automobile and becomes a switch having a high stroke and a high click feeling. In addition, the push-button switch member 1*n* also exerts an excellent silencing effect.

Figure 16:
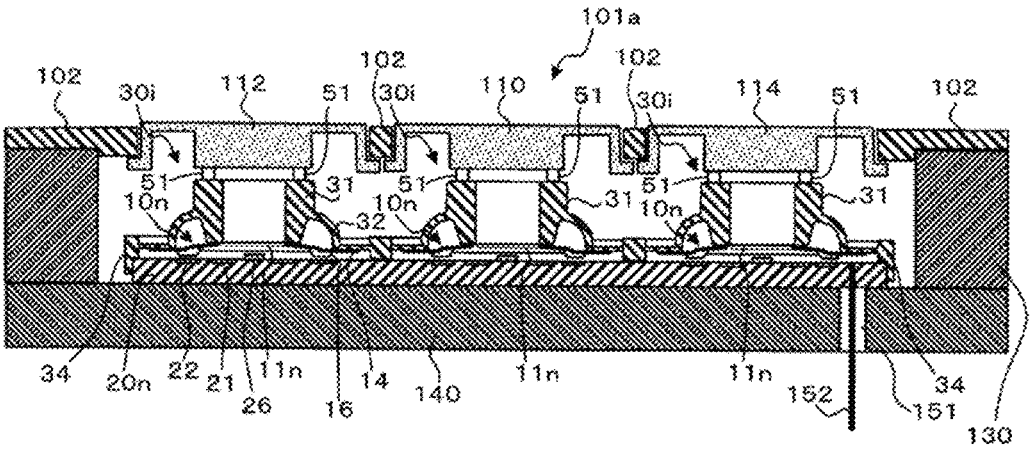
FIG. 16 illustrates a longitudinal sectional view of a variation of the multi-key illustrated in FIG. 15C.

FIG. 16 illustrates a longitudinal sectional view of a variation of the multi-key illustrated in FIG. 15C.

A multi-key 101*a* illustrated in FIG. 16 is different from the multi-key 101 illustrated in FIGS. 15A to 15C and includes the protruding portion 51 on the top surface of the key body 31, and the other constitutions are the same as the multi-key 101. By using the operation key 30*i* including such protruding portion 51, higher stroke during the pressing operation can be realized.

(Performance Evaluation by Keying Test)

Figure 17A:
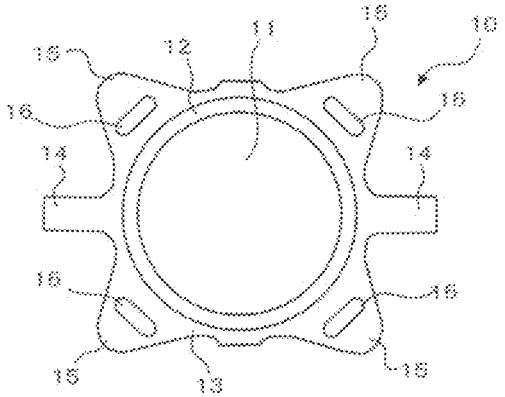
FIG. 17A illustrates a plan view of the movable contact in the first embodiment and FIG. 17B illustrates a performance evaluation result when a keying test is conducted with the movable contact as a sample.
Figure 17B:
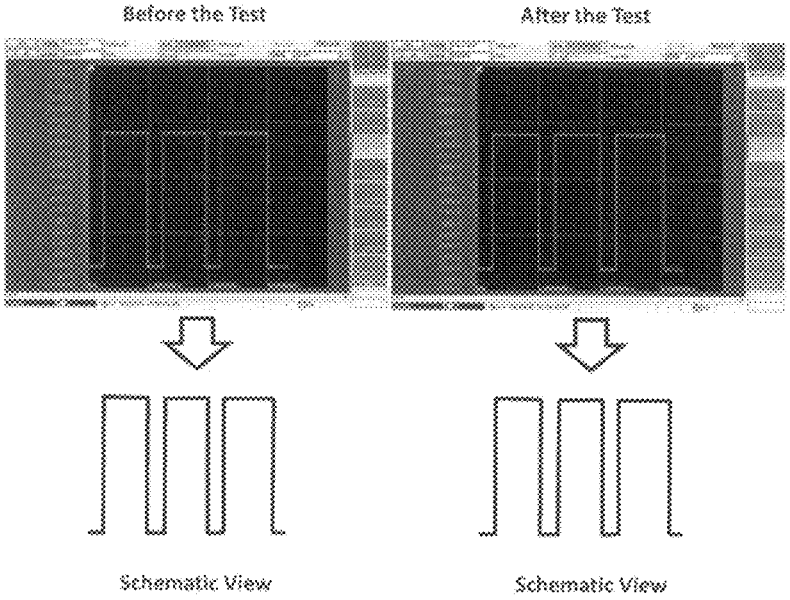
Figure 18A:
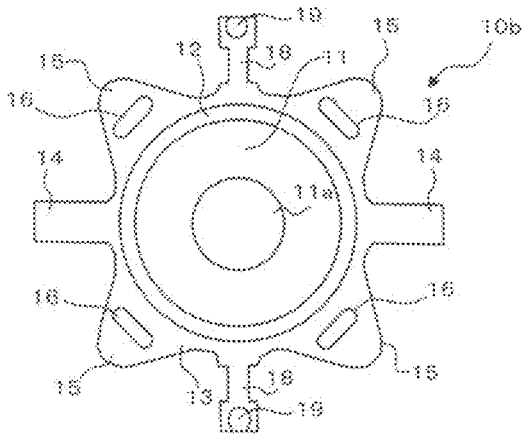
FIG. 18A illustrates a plan view of the movable contact in the third embodiment and FIG. 18B illustrates a performance evaluation result when a keying test is conducted with the movable contact as a sample.
Figure 18B:
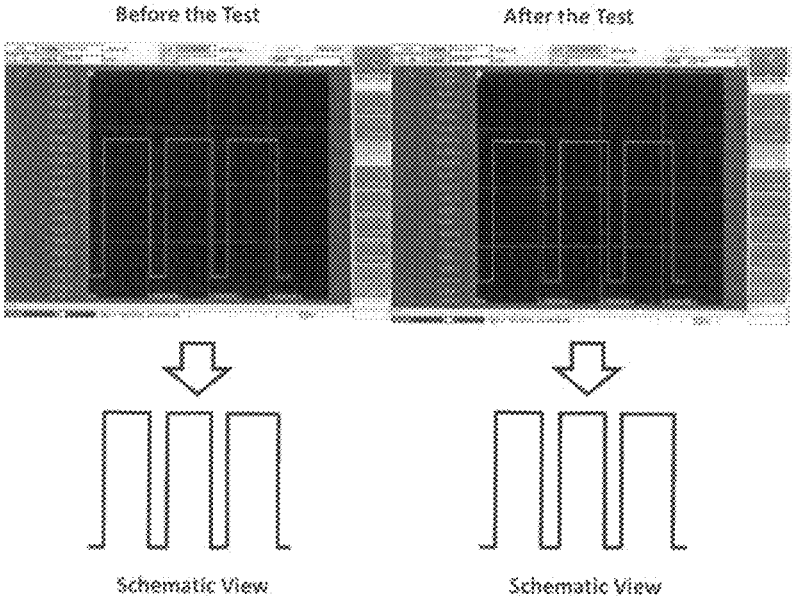
Figure 19A:
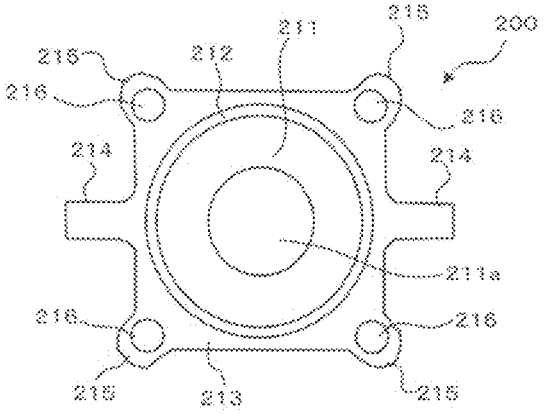
FIG. 19A illustrates a plan view of a conventionally well-known movable contact and FIG. 19B illustrates a performance evaluation result when a keying test is conducted with the movable contact as a sample.
Figure 19B:
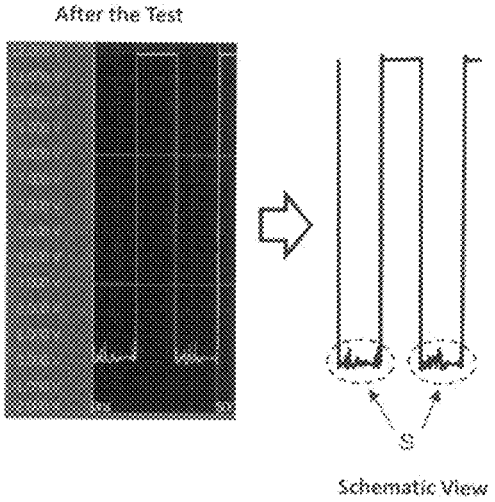

FIG. 17A illustrates a plan view of the movable contact in the first embodiment and FIG. 17B illustrates a performance evaluation result when a keying test is conducted with the movable contact as a sample. FIG. 18A illustrates a plan view of the movable contact in the third embodiment and FIG. 18B illustrates a performance evaluation result when a keying test is conducted with the movable contact as a sample. FIG. 19A illustrates a plan view of a conventionally well-known movable contact and FIG. 19B illustrates a performance evaluation result when a keying test is conducted with the movable contact as a sample. In FIG. 17B, FIG. 18B, and FIG. 19B, schematic views of waveforms are also illustrated by considering that the waveforms on photos are hard to be seen.

Since the structures of the movable contacts 10 and 10*b* have been already described in the first embodiment and the third embodiment, the description will be omitted here. A conventionally well-known movable contact 200 includes a dome-shaped upper contact portion 211 at a substantially center on the plan view, a stepped portion 212 formed on the outer side in the radial direction thereof and having a substantially annular shape on the plan view, and a baseboard portion 213 extending to the outer side in the radial direction of the stepped portion 212 in a substantially horizontal direction and having a substantially rectangular shape on the plan view. The upper contact portion 211 has a first through hole 211*a* penetrating in the vertical direction substantially at the center on the plan view. The baseboard portion 213 protrudes portions 215, 215, 215, and 215 corresponding to the four corners of the substantially rectangular shape on diagonal lines on the plan view. A band portion 214 extending by protruding to the outer side in the radial direction is provided at an intermediate position of the lengths of facing two sides of the baseboard portion 213 on the plan view. The band portion 214 is a fixed portion with the operation key. The portion 215 includes a non-contacting outer contact portion 216 protruding downward on the lower surface thereof. The non-contacting outer contact portion 216 is a portion protruding downward with a semispherical shape and is in point-contact when brought into contact with the contact on the substrate. The non-contacting outer contact portion 216 as above is definitely different from the movable contact 10 including the non-contacting outer contact portion 16 capable of planar contact with the second contact 22 or the movable contact 10*b* including the contacting outer contact portion 18 in contact with the second contact 25 at all times from before pressing.

A testing machine having the following mechanism was used in the keying test. A cam mechanism for moving a table on which a test sample is placed vertically is installed below the table. A keying cycle of the table is determined by a rotation speed of a cam. A weight which serves as a human finger is installed on an upper part of the test sample. The testing machine has a structure such that, when the table rises to a certain height or more, the test sample is brought into contact with a weight and a load is applied. Conditions of the keying test are as follows:

Applied load: 12 N

Number of keying times: 300 thousand times (repetition of once/second)

Voltage: 12 V

Current: 20 mA

As illustrated in FIG. 17B, when behaviors of the voltage during a switch operation are compared between before start of the test of the movable contact 10 and after the test is finished, a difference was hardly found between before and after the test, and a digital-type waveform was obtained. In the movable contact 10*b*, too, a difference was hardly found between before and after the test, and the digital-type waveform was obtained similarly to the movable contact 10.

On the other hand, in the conventionally well-known movable contact 200, micro-motion in a voltage as indicated by an arrow S in FIG. 19B was found from the beginning of the keying test to after the test was finished. Since the non-contacting outer contact portion 216 and an electrode of the substrate are free from each other in the conventional structure, vibration occurs when the push-button switch is pressed, and the movable contact is deformed. This phenomenon is called bouncing. Repetition of such bouncing damages gold-plating on the electrode surface of the substrate and even the electrode itself, which incurs corrosion, and a contact resistance value between the movable contact and the electrode rises and causes a concern that the push-button does not function as a switch.

In the movable contacts 10 and 10*b* according to the embodiments illustrated in FIGS. 17A, 17B, 18A and 18B, such conventional defect hardly occurs. In the movable contact 10, contact stability between the non-contacting outer contact portion 16 and the second contact 22 can be secured by increasing a contact area between them. In the movable contact 10*b*, even if the bouncing occurs between the downward protruding portion 16*b* and the substrate 20*b*, the vibration is absorbed by the spring effect of the contacting outer contact portion 18 by providing the portion 19 on the movable contact 10*b*, and the contact stability between the portion 19 and the second contact 25 can be ensured.

Other Embodiments

As described above, preferred embodiments of the push-button switch member of the present invention have been described, but the present invention is not limited to the aforementioned embodiments but can be implemented with various variations.

The band portion 14 described above is only an example of an outer fixed portion fixed closer to the outer side in the radial direction than the key body 31 of the operation keys 30, 30*a*, 30*b*, 30*g*, 30*h*, 30*i*, 30*j*, 30*k*, 30*l*, and 30*m* (hereinafter, referred to as the "operation key 30 and the like"). The outer fixed portion fixing movable contacts 10, 10*a*, 10*b*, 10*c*, 10*d*, 10*e*, 10*f*, 10*g*, and 10*n* (hereinafter, referred to as the "movable contact 10 and the like") and the operation key 30 and the like only need to be capable of fixing on the upper contact portion 11 or closer to the outer side in the radial direction than that and to be capable of fixing closer to the outer side in the radial direction than the key body 31.

Moreover, the fixing method between the outer fixed portion represented by the band portion 14 and the operation key 30 and the like may be any method such as fixing using an adhesive, fixing using a double-sided tape, fixing by fitting, fixing by forming a groove in the operation key 30 and the like and by inserting the outer fixed portion in the groove and the like other than the method of using the fixing sheet 40 in FIG. 12. Moreover, a fixing position between the movable contact 10 and the like and the operation key 30 and the like is not particularly restricted as long as it is on the dome top or its vicinity of the movable contact 10 and the like and closer to the outer side in the radial direction of the movable contact 10 and the like than a position in contact with the contact on the innermost side (the first contact 21, for example).

If the illuminating means represented by the LED 26 is not disposed at a position immediately below the movable contact 10 and the like, the first through holes 11*a*, 11*b*, and 11*n* do not necessarily have to be provided on the movable contact 10 and the like. Moreover, if the LED 26 and the pressor 36 are not in contact when the operation key 30 and the like are pressed, the recess portion 55 does not have to be formed on the key body 31. Moreover, the at least two contacts are not limited to the first contact 21 and the second contacts 22 and 25 but may include other contacts. Furthermore, the number of contact times between the movable contact 10 and the like and the contacts 21, 22, and 25 is not particularly restricted.

Other than the dot-shaped ones such as the protruding portions 37, 51, and 53, a protruding portion having a bar shape which is long in one direction may be provided. The number of protruding portions may be one to three or five or more. A dot-shaped or bar-shaped protruding portion may be further formed on the inner side or on the outer side of the annular member of the protruding portions 50 and 52. A columnar portion such as the protruding portion 60 may be an annular or frame-shaped wall body completely or partially surrounding a periphery of the key body 31. The operation plate 61 may have a hole penetrating in its thickness direction or a light-transmissive lid portion or a filling portion partially or wholly closing a depth direction of the hole.

The various constituent elements of the push-button switch members 1, 1*a*, 1*b*, 1*h*, 1*m*, and 1*n* in each of the embodiments can be arbitrarily combined with each other except a case where combination is impossible. For example, the fixing sheet 40 used for the operation key 30*g* (see FIG. 12) may be also used for the other operation key 30 and the like. Moreover, the operation keys 30*i*, 30*j*, 30*k*, and 30*l* described in the fourth embodiment may be also used in each of the first to third and the fifth embodiments. Other than that, the constituent elements in each of the claims can be freely combined with each other except the case where combination is impossible technically or structurally.

INDUSTRIAL APPLICABILITY

The push-button switch member according to the present invention can be used in various equipment including the operation key, such as portable communication equipment, PC, cameras, automobiles, onboard electronic equipment, home audio devices, home electric appliances and the like.

The invention claimed is:

1. A push-button switch member, comprising:
a dome-shaped movable contact;
a substrate on which at least two contacts including a first contact and a second contact are disposed; and
an operation key facing a protruding side of the movable contact and configured to be in contact with or away from the protruding side of the movable contact, and electrically conduct the movable contact with the at least two contacts on the substrate upon pressing the operation key in a direction of the movable contact, wherein
the operation key includes:
a key body;
a dome portion connected to an outer periphery of the key body and deformable upon pressing the key body toward the substrate;
a foot portion connected to an outer periphery of the dome portion and fixed onto the substrate; and
an intermediate portion facing the substrate and defining a gap between the dome portion and the foot portion,
the movable contact includes:
an upper contact portion disposed immediately below the key body and configured to be brought into contact with the first contact upon pressing the key body toward the substrate;
an outer fixed portion on the upper contact portion or closer to an outer side of the movable contact in a radial direction of the movable contact than the upper contact portion, the outer fixed portion closer to the outer side in the radial direction than the key body of the operation key; and
an outer contact portion located closer to the outer side in the radial direction of the movable contact than the upper contact portion and facing in a non-contact state the second contact, said outer contact portion being configured to be in contact with the second contact disposed on the outer side in the radial direction of the first contact upon pressing the key body toward the substrate,
the outer contact portion includes a bottom portion configured to be in linear contact or planar contact with the second contact,
the outer fixed portion of the movable contact is elongated from the upper contact portion toward the outer side in the radial direction, and
the outer fixed portion of the movable contact is directly fixed to the intermediate portion.

2. The push-button switch member of claim 1, wherein
the movable contact has a first through hole in a region including a center part on a plan view thereof and is configured to be brought into contact with the key body in a periphery of the first through hole upon pressing the operation key in the direction of the movable contact.

3. The push-button switch member of claim 2, wherein
the substrate includes illuminating means provided on an inner side of said one contact in the radial direction, and
light is transmissive from the illuminating means through the first through hole.

4. The push-button switch member of claim 3, wherein
the operation key includes a recess portion configured to accommodate the illuminating means on a lower part of the key body upon pressing the key body toward the substrate, and
at least a part of the key body is light-transmissive.

5. The push-button switch member of claim 1, wherein
the operation key includes a second through hole penetrating the key body, toward the movable contact.

6. The push-button switch member of claim 5, wherein
a light-transmissive material is embedded over a part or an entire length of the second through hole.

7. The push-button switch member of claim 1, wherein
the operation key is made of a light-transmissive material.

8. The push-button switch member of claim 1, further comprising:
a protruding portion provided on a top surface or an outer periphery of the key body, protruding from the top surface of the key body, and configured to be compressed or deformed during an operation of pressing the operation key toward the substrate.

9. The push-button switch member of claim 8, wherein
the protruding portion has a dot shape, a bar shape, a frame shape or an annular shape on the top surface of the key body.

10. The push-button switch member of claim 8, wherein
the protruding portion is a columnar portion on an outer periphery of the key body and extending more upward than the top surface of the key body.

11. A push-button switch member, comprising:
a dome-shaped movable contact;
a substrate on which at least two contacts including a first contact and a second contact are disposed; and
an operation key facing a protruding side of the movable contact and configured to be in contact with or away from the protruding side of the movable contact, and electrically conduct the movable contact with the at least two contacts on the substrate upon pressing the operation key in a direction of the movable contact, wherein
the operation key includes:
a key body;
a dome portion connected to an outer periphery of the key body and deformable upon pressing on the key body toward the substrate;
a foot portion connected to an outer periphery of the dome portion and fixed onto the substrate; and
an intermediate portion facing the substrate and defines a gap between the dome portion and the foot portion,
the movable contact includes:

an upper contact portion disposed immediately below the key body and configured to be brought into contact with the first contact upon pressing the key body toward the substrate;

an outer fixed portion on the upper contact portion or closer to an outer side of the movable contact in a radial direction of the movable contact than the upper contact portion, the outer fixed portion closer to the outer side in the radial direction than the key body of the operation key; and a contacting outer contact portion located at an outermost end of the movable contact in the radial direction and closer to the outer side in the radial direction of the movable contact than the upper contact portion, said contacting outer contact portion being in contact with and disposed on the second contact which is disposed on the outer side in the radial direction of the first contact, the outer fixed portion of the movable contact is elongated from the upper contact portion toward the outer side in the radial direction, and the outer fixed portion of the movable contact is directly fixed to the intermediate portion.

12. The push-button switch member of claim 11, wherein the movable contact further includes a downward protruding portion closer to the outer side in the radial direction of the movable contact than the upper contact portion and disposed in contact with or in non-contact with the substrate on the outer side in the radial direction of the first contact.

13. The push-button switch member of claim 12, wherein the downward protruding portion is an outer contact portion facing the second contact in a non-contact state and configured to be in contact with the second contact upon pressing the key body toward the substrate, and the outer contact portion includes a bottom portion configured to be in linear contact or planar contact with the second contact.

* * * * *